US008378910B2

(12) United States Patent
Wolf

(10) Patent No.: US 8,378,910 B2
(45) Date of Patent: Feb. 19, 2013

(54) SLOT ANTENNAS, INCLUDING MEANDER SLOT ANTENNAS, AND USE OF SAME IN CURRENT FED AND PHASED ARRAY CONFIGURATION

(75) Inventor: Forrest Wolf, Reno, NV (US)

(73) Assignee: Pinyon Technologies, Inc., Reno, NV (US)

( * ) Notice: Subject to any disclaimer, the term of this patent is extended or adjusted under 35 U.S.C. 154(b) by 512 days.

(21) Appl. No.: 12/567,535

(22) Filed: Sep. 25, 2009

(65) Prior Publication Data

US 2010/0085262 A1 Apr. 8, 2010

Related U.S. Application Data

(60) Provisional application No. 61/100,156, filed on Sep. 25, 2008.

(51) Int. Cl.
*H01Q 13/00* (2006.01)

(52) U.S. Cl. ..... 343/768

(58) Field of Classification Search ..... 343/868, 343/860, 822, 895, 700 MS, 702, 768
See application file for complete search history.

(56) References Cited

U.S. PATENT DOCUMENTS

| | | | | |
|---|---|---|---|---|
| 5,754,143 | A * | 5/1998 | Warnagiris et al. | 343/767 |
| 7,924,231 | B2 * | 4/2011 | Hill et al. | 343/702 |
| 2001/0015703 | A1 | 8/2001 | Nieminen | |
| 2005/0024287 | A1 * | 2/2005 | Jo et al. | 343/822 |
| 2005/0057412 | A1 * | 3/2005 | Hwang et al. | 343/767 |
| 2008/0316115 | A1 * | 12/2008 | Hill et al. | 343/702 |

FOREIGN PATENT DOCUMENTS

| | | | |
|---|---|---|---|
| JP | 2005110332 | A | 4/1993 |
| JP | 2005223879 | A | 8/2005 |
| JP | 2006527941 | A | 12/2006 |
| KR | 1020050026334 | A | 3/2005 |

OTHER PUBLICATIONS

Search Report and Written Opinion mailed Jan. 4, 2010 for Application No. PCT/US2009/058471, 9 pages.

* cited by examiner

*Primary Examiner* — Huedung Mancuso

(74) *Attorney, Agent, or Firm* — Holland & Hart LLP

(57) ABSTRACT

In one embodiment, a meander slot antenna includes a conducting sheet having a meander slot defined therein. The meander slot has a closed area defined by the conducting sheet. An electrical microstrip feed line crosses the meander slot. The electrical microstrip feed line and meander slot provide a magnetically coupled LC resonance element. A dielectric material has at least one conductive via therein. The at least one conductive via electrically connects the electrical microstrip feed line and the conducting sheet at a side of the meander slot. The dielectric material otherwise separates the conducting sheet from the electrical microstrip feed line. Other embodiments are also disclosed.

41 Claims, 33 Drawing Sheets

| Antenna Type | Operating Frequency (GHz) | Primary Gain | Secondary Gain | Total Gain |
|---|---|---|---|---|
| Meander Slot | 2.400 | 3.20 | -2.50 | 0.70 |
| | 2.440 | 3.24 | -2.36 | 0.88 |
| | 2.484 | 3.30 | -4.20 | -0.90 |
| Average | | 3.25 | -3.02 | 0.23 |
| Rectangular Slot | 2.400 | 6.80 | -11.20 | -4.40 |
| | 2.440 | 5.84 | -12.16 | -6.32 |
| | 2.484 | 5.90 | -13.20 | -7.30 |
| Average | | 6.18 | -12.19 | -6.01 |

FIG. 29

Gain @2442 MHz = 1.47 dBi

Micro strip feed line to slot attachment point the line printed circuit board to this point.

Micro strip feed line to slot attachment point the line printed circuit board to this point.

SLOT ANTENNAS, INCLUDING MEANDER SLOT ANTENNAS, AND USE OF SAME IN CURRENT FED AND PHASED ARRAY CONFIGURATION

CROSS-REFERENCE TO RELATED APPLICATION

This application claims the benefit of U.S. provisional patent application No. 61/100,156, filed Sep. 25, 2008, which application is hereby incorporated by reference. This application is related to U.S. patent application Ser. No. 12/115,537, filed May 5, 2008, to U.S. patent application Ser. No. 11/694,916, filed Mar. 30, 2007, and to U.S. Pat. No. 7,202,830, filed Feb. 9, 2005 and issued Apr. 10, 2007, all of which are hereby incorporated by reference.

BACKGROUND

Electronic devices are ubiquitous in today's world. Many of these devices are mobile devices, or are being replaced with mobile devices. Devices such as mobile phones and laptop computers have long been able to communicate via telecommunications networks—with each other, or with other mobile or stationary devices. However, additional devices are being enabled with communication and networking capabilities. These devices include gaming devices, personal music players, electronic books, and medical devices, to name a few. In addition, formerly non-networked devices, such as refrigerators, lighting systems, sprinkler systems and power systems are being fitted with communication and networking capabilities. At the same time, both businesses and individuals are implementing wireless networks at an ever-increasing rate, to facilitate the networking of all of these devices.

Given the above climate, device manufacturers are in need of antennas that offer broader bandwidth, smaller size and/or higher gain—all at a lower cost.

SUMMARY

In one embodiment, a meander slot antenna comprises a conducting sheet having a meander slot defined therein. The meander slot has a closed area defined by the conducting sheet. An electrical microstrip feed line crosses the meander slot. The electrical microstrip feed line and meander slot provide a magnetically coupled LC resonance element. A dielectric material has at least one conductive via therein. The at least one conductive via electrically connects the electrical microstrip feed line and the conducting sheet at a side of the meander slot. The dielectric material otherwise separates the conducting sheet from the electrical microstrip feed line.

In another embodiment, a meander slot antenna comprises a conducting sheet having a meander slot defined therein. The meander slot has a closed area defined by the conducting sheet. An electrical microstrip feed line crosses only one of a plurality of slot segments of the meander slot. The electrical microstrip feed line is connected to the conducting sheet at a side of the meander slot, between adjacent ones of the slot segments of the meander slot. The electrical microstrip feed line and meander slot provide a magnetically coupled LC resonance element. A dielectric material separates the conducting sheet from the electrical microstrip feed line, but for where the electrical microstrip feed line is connected to the conducting sheet.

In yet another embodiment, a slot antenna comprises a conducting sheet having a slot and a capacitor defined therein. The slot has a closed area defined by the conducting sheet. The capacitor is formed across the slot and has first and second plates that are respectively coupled to first and second sides of the slot. An electrical microstrip feed line crosses the slot and is connected to the conducting sheet at a side of the slot. The electrical microstrip feed line and slot provide a magnetically coupled LC resonance element. A dielectric material separates the conducting sheet from the electrical microstrip feed line, but for where the electrical microstrip feed line is connected to the conducting sheet.

In a still further embodiment, a slot antenna comprises a conducting sheet having a slot defined therein. The slot has a closed area defined by the conducting sheet. An electrical microstrip feed line crosses the slot and is connected to the conducting sheet at a side of the slot. The electrical microstrip feed line and slot provide a magnetically coupled LC resonance element. A dielectric material separates the conducting sheet from the electrical microstrip feed line, but for where the electrical microstrip feed line is connected to the conducting sheet. The slot antenna further comprises a capacitor. The capacitor has i) first and second terminals coupled to the conductive sheet, and ii) first and second spaced plates, each of the first and second spaced plates projecting across the meander slot. The dielectric material separates the conducting sheet from the first and second spaced plates.

In another embodiment, a method comprises: 1) providing a meander slot in a conducting sheet on a first side of a dielectric material, the meander slot having a plurality of slot segments; 2) on a second side of the dielectric material, opposite the first side of the dielectric material, providing an electrical microstrip feed line, the electrical microstrip feed line routed to cross the meander slot only once; and 3) electrically connecting the electrical microstrip feed line to the meander slot, at a position between adjacent ones of the plurality of slot segments.

Other embodiments are also disclosed.

BRIEF DESCRIPTION OF THE DRAWINGS

Illustrative embodiments of the invention are illustrated in the drawings, in which:

FIG. 29 provides a table of vertical, horizontal and total gain for the rectangular and meander slot antennas shown in FIGS. 23-28;

DETAILED DESCRIPTION

The following description describes the configuration and use of novel meander slot antennas, and particularly, novel current fed meander slot antennas. It is noted, however, that certain aspects of the methods and apparatus described herein can be applied to antennas other than meander slot antennas.

For purposes of this description, the term "meander slot" is defined to be a slot that follows a single winding path, with the single winding path having two or more changes in direction. The changes in direction will typically be 90° changes in direction. However, changes in direction at others angles are included within the definition of meander slot. By way of example and not limitation, FIGS. 1-6 illustrate various exemplary configurations of meander slots 100, 200, 300, 400, 500, 600 having single winding paths. As shown, each meander slot 100, 200, 300, 400, 500, 600 has a plurality of connected slot segments (e.g., meander slot 100 has five slot segments 102, 104, 106, 108, 110).

Figure 1:
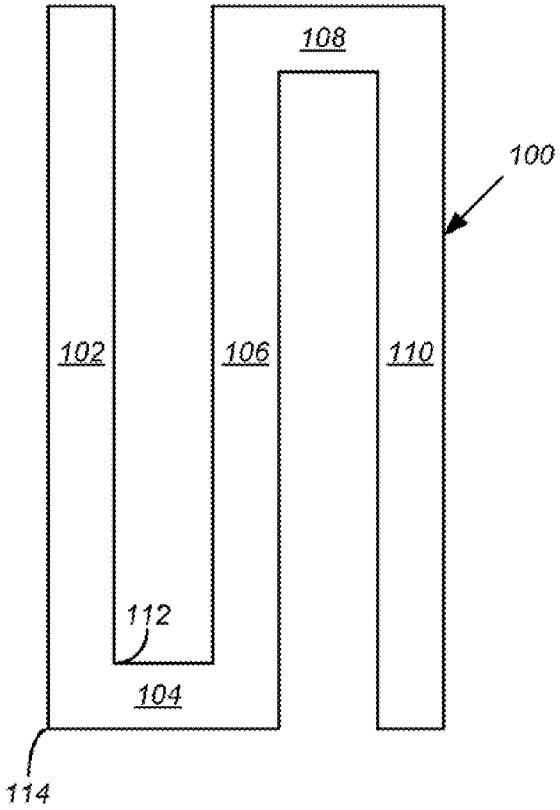
FIGS. 1-6 illustrate various exemplary configurations of meander slots.
Figure 2:
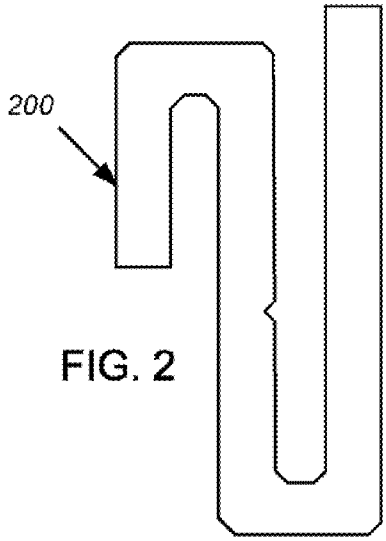
Figure 3:
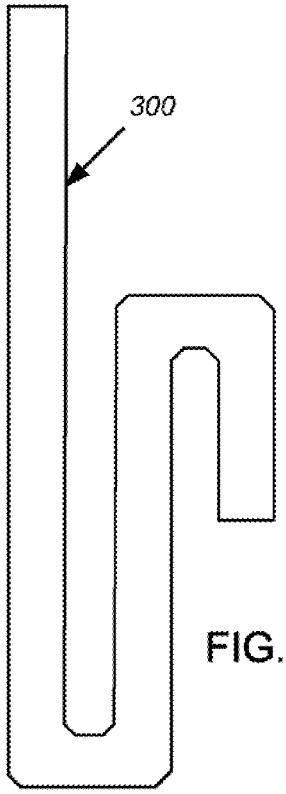
Figure 4:
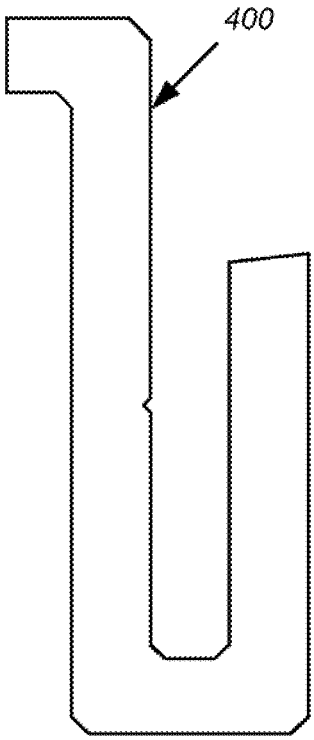
Figure 5:
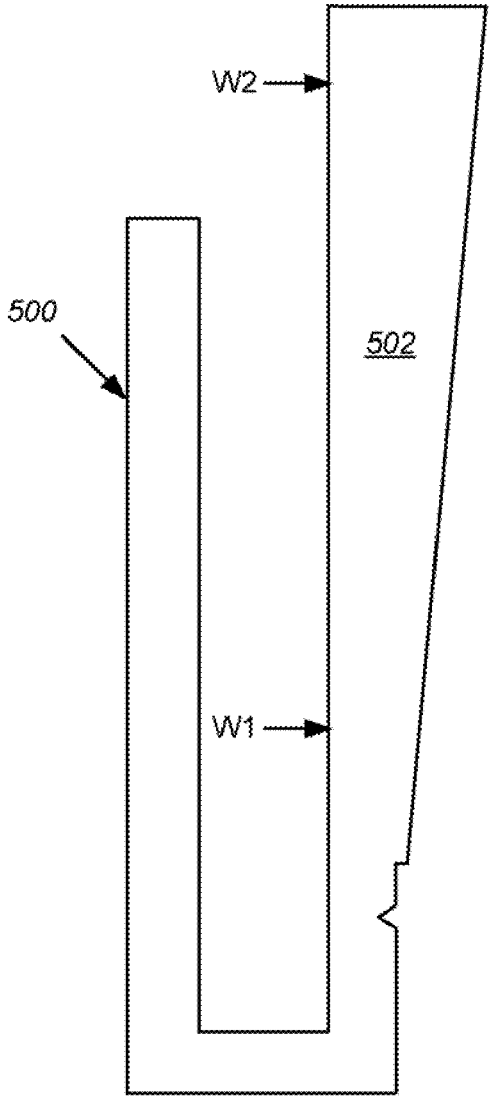
Figure 6:
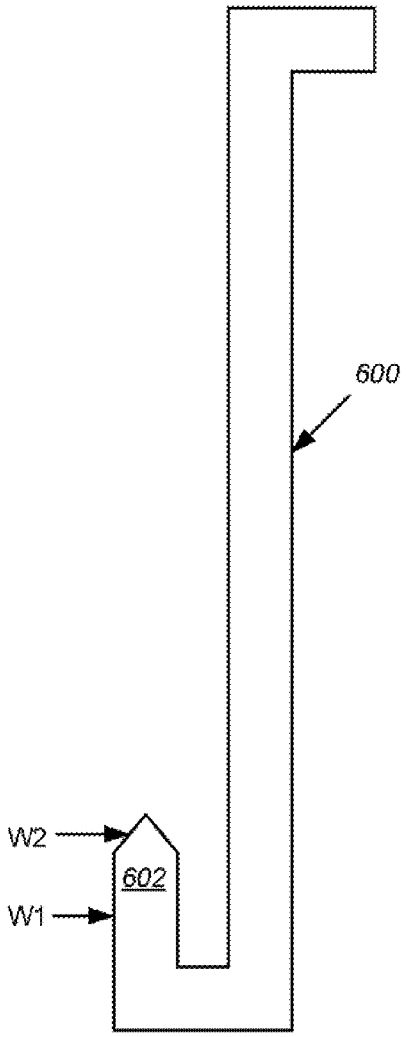
Figure 7:
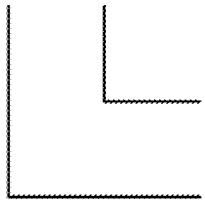
FIGS. 7-10 illustrate various exemplary configurations for the inside and outside corners at a meander slot change in direction.
Figure 8:
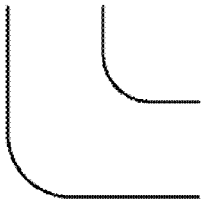
Figure 9:
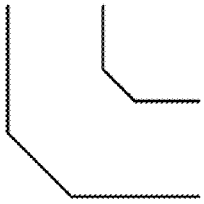
Figure 10:
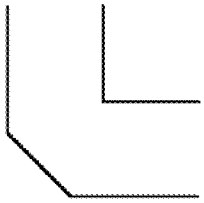

At each change in direction, a meander slot will have an inside corner and an outside corner (see, e.g., corners 112 and 114 in FIG. 1). The corners at a particular change in direction (i.e., corresponding inside and outside corners) may have similar or different profiles. The corner profiles may include, for example, sharp corners, rounded corners or faceted corners. By way of example and not limitation, FIGS. 7-10 illustrate various exemplary configurations of the corners at a meander slot change in direction. FIG. 7 illustrates a pair of sharp corners. FIG. 8 illustrates a pair of rounded corners. FIG. 9 illustrates a pair of faceted corners. FIG. 10 illustrates a sharp insider corner and a faceted outside corner.

Having described the term "meander slot" in general, various exemplary configurations of a "meander slot antenna" will now be described.

Figure 11:
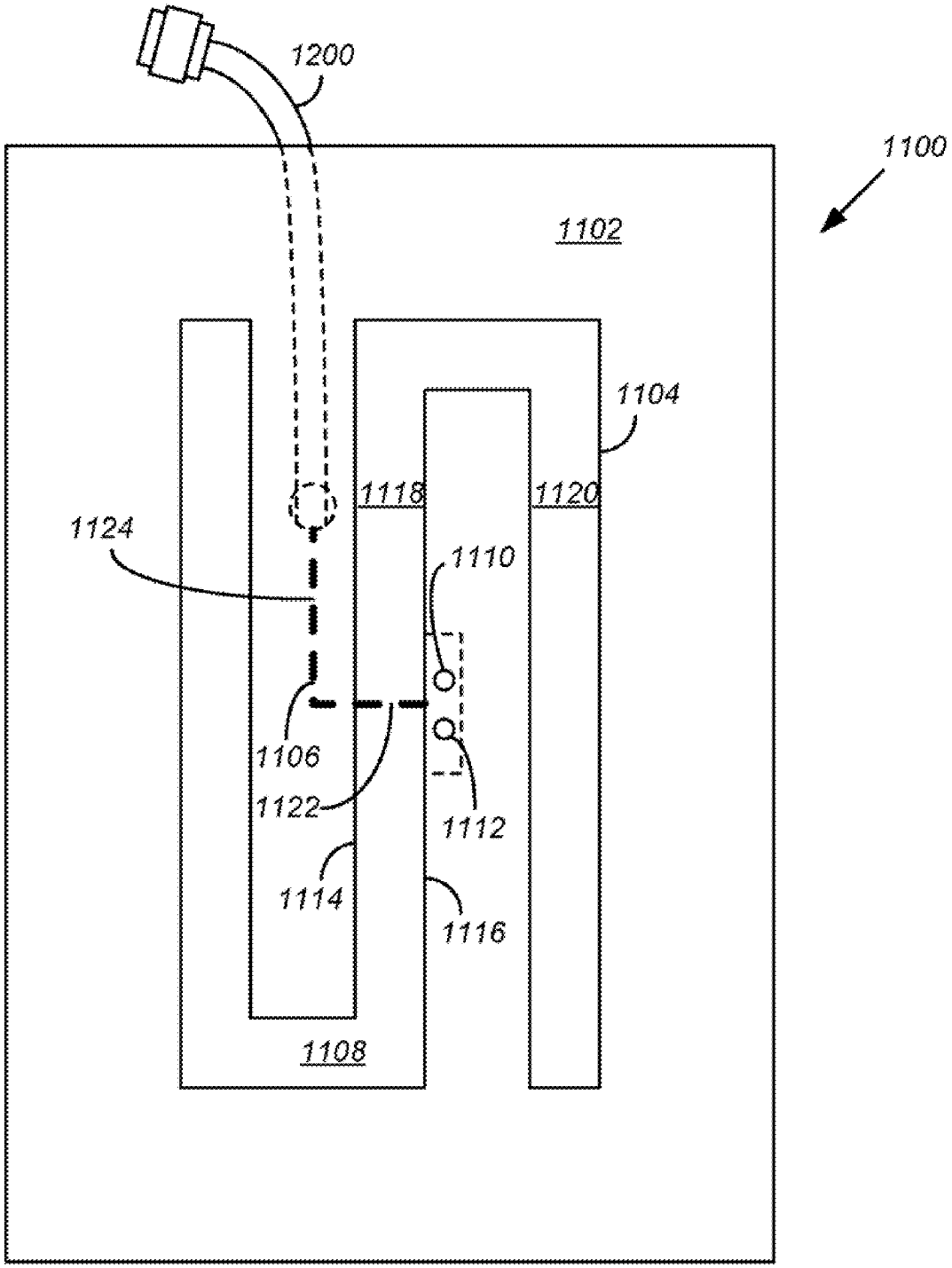
FIGS. 11-13 illustrate a first exemplary embodiment of a meander slot antenna.
Figure 12:
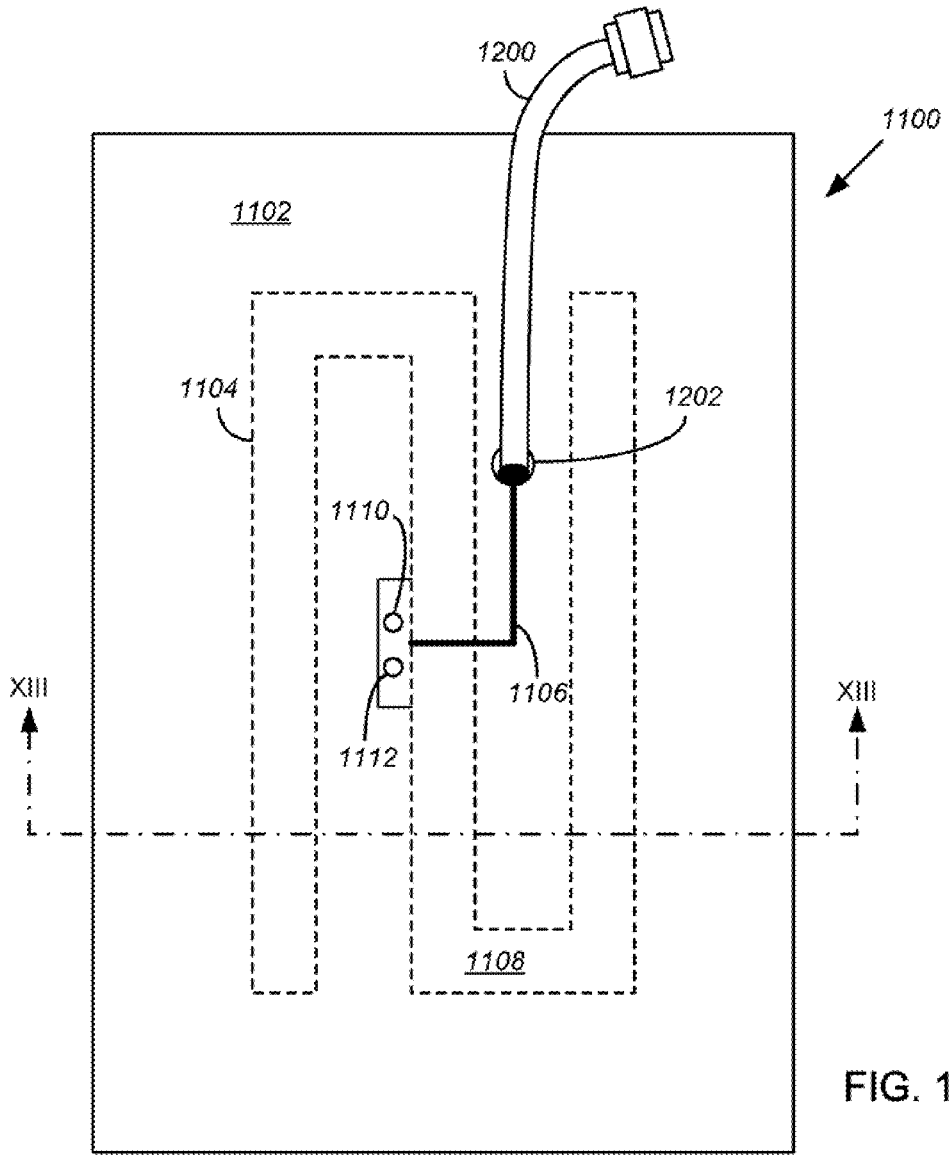
Figure 13:
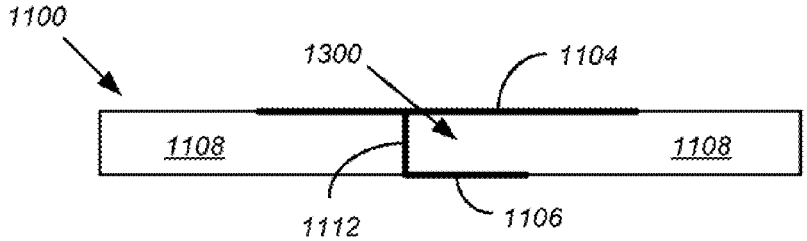

FIGS. 11-13 illustrate a first embodiment of a meander slot antenna 1100. FIG. 11 illustrates what will be referred to as the front side of the antenna 1100; FIG. 12 illustrates what will be referred to as the back side of the antenna 1100; and FIG. 13 illustrates a cross-sectional elevation of the antenna 1100. The "front" and "back" designations are purely arbitrary, and are used solely to provide a frame of reference for describing the antenna 1100.

As best shown in FIG. 11, the meander slot antenna 1100 includes a conducting sheet 1102 having a meander slot 1104 defined therein. By way of example, the conducting sheet 1102 can be an area of sheet metal, such as an area of copper, aluminum or steel. The meander slot 1104 has a closed area defined by the conducting sheet 1102. A dashed line illustrates the position of an electrical microstrip feed line 1106 with respect to the meander slot 1104. The electrical microstrip feed line 1106 is separated from the conducting sheet 1102 by a dielectric material 1108. In FIG. 11, the dielectric material 1108 is visible through the meander slot 1104.

In some embodiments, the meander slot antenna 1100 may be built as a three or four layer printed circuit board, where the outside layers respectively provide the metallization for the conducting sheet 1102 and the electrical microstrip feed line 1106, and where the inner layer(s) provide the dielectric material 1108 (e.g., FR4 or another dielectric). Conductors such as a number of conductive vias 1110, 1112 may be formed in the dielectric material 1108 for the purpose of electrically connecting the electrical microstrip feed line 1106 to the conducting sheet 1102. In this manner, the meander slot 1104 may be "current fed" via the electrical microstrip feed line 1106.

FIG. 12 illustrates the back side of the meander slot antenna 1100. This side of the antenna includes the electrical microstrip feed line 1106. A dashed line illustrates the position of the meander slot 1104 with respect to the electrical microstrip feed line 1106. A coax cable 1200, coax cable connector, or other form of conductor may be coupled to the electrical microstrip feed line at, for example, a solder pad 1202. The "other form of conductor" may in some cases take the form of a non-coax radio frequency (RF) feed line.

As best shown in FIG. 13, the electrical microstrip feed line 1106 crosses the meander slot 1104 such that the electrical microstrip feed line 1106 and meander slot 1104 provide a magnetically coupled LC resonance element 1300.

As shown in FIGS. 11-13, the dielectric material 1108 has one or more conductors 1110, 1112 formed therein. These conductors electrically connect the electrical microstrip feed line 1106 and the conducting sheet 1102 at a side of the meander slot 1104. In some embodiments, the one or more conductors can be a number of one or more conductive vias 1110, 1112 formed in the dielectric material 1108, and in some embodiments, the conductive vias 1110, 1112 connect to the electrical microstrip feed line 1106 and conducting sheet 1102 at one or more solder connections. In some embodiments, the solder connection(s) between the conductive via(s) and the electrical microstrip feed line 1106 provide a 50Ω connection point between the electrical microstrip feed line 1106 and the conducting sheet 1102.

Other than where the one or more conductors electrically connect the electrical microstrip feed line 1106 to the conducting sheet 1102, the dielectric material 1108 separates the conducting sheet 1102 from the electrical microstrip feed line 1106. The dielectric material 1108 may be formed of FR4, or of RO-3010 or RO-4350B of the Rogers Corporation. Different dielectric materials may be used for different configurations of meander slot antennas, as necessary to enable a meander slot antenna to exhibit enhanced performance with a lower loss tangent, smaller size, higher gain or combination thereof. A dielectric material such as RO-3010 has a higher dielectric constant than, for example, FR4. Thus, antennas having similar performance characteristics can be made thinner or smaller when using RO-3010 as the dielectric material 1108 (versus FR4). For example, the use of RO-3010 versus FR4 has enabled an approximate 60% reduction in slot size/area in some meander slot antennas.

As previously mentioned, the electrical microstrip feed line 1106 may be coupled to a coax cable 1200, which coax cable 1200 is soldered to a solder pad 1202 to which the electrical microstrip feed line 1106 is coupled. Alternately, a coax connector can be soldered to the electrical microstrip fee line 1106, and a coax cable can be coupled to the connector; or, another form of electrical connection could be made to the electrical microstrip feed line 1106. The coax cable 1200 may connect the meander slot antenna 1100 to a transmitter, receiver or transceiver for sending or receiving signals via the meander slot antenna 1100. In some cases, the transmitter, receiver or transceiver can transmit or receive signals from/to a mobile phone, laptop computer, wireless router or other mobile or stationary device, and the meander slot antenna 1100 may be provided internally or externally to such device. In some embodiments, the meander slot antenna 1100 can also be manufactured on a dielectric material (or substrate) shared by other components of the device in which the antenna 100 is used.

Figure 14:
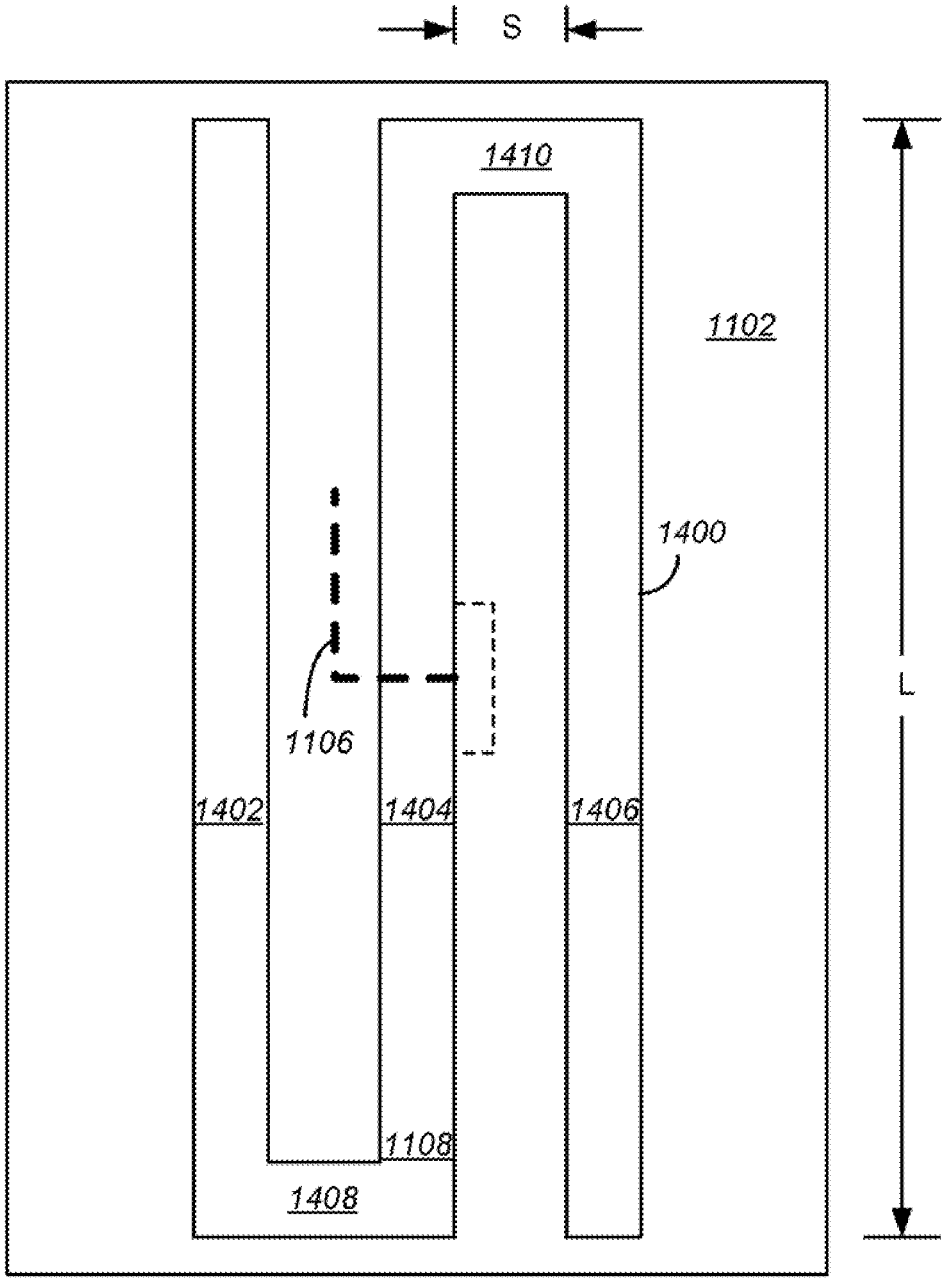
FIG. 14 illustrates an alternate embodiment of the meander slot antenna shown in FIG. 11, wherein the meander slot is longer.

The resonant frequency and bandwidth of a meander slot antenna are functions of various parameters, including, for example, the number of slot segments that form the meander slot, the area of the slot, and the dimensions of the meander slot. The dimensions of the meander slot include, for example, the length and width of each slot segment, and the spacing between slot segments. Meander slot antennas having different resonant frequencies and bandwidths can therefore be constructed by changing any one or more of these parameters. In this regard, FIG. 14 illustrates a meander slot 1400 of greater length, L, than the meander slot 1104 shown in FIGS. 11 & 12. By way of example, the greater length of the meander slot 1400 is achieved by lengthening the vertical slot segments 1402, 1404, 1406 of the meander slot 1400. Alternately, the horizontal slot segments 1408, 1410 can be lengthened, a combination of vertical and horizontal slot segments can be lengthened, or only a subset of vertical or horizontal slot segments can be lengthened. In a similar manner, any of the slot segments 1402, 1404, 1406, 1408, 1410 can be shortened. Decreasing the spacing, S, between adjacent slot segments (e.g., segments 1402, 1404) generally increases the resonant frequency of a meander slot antenna.

Figure 15:
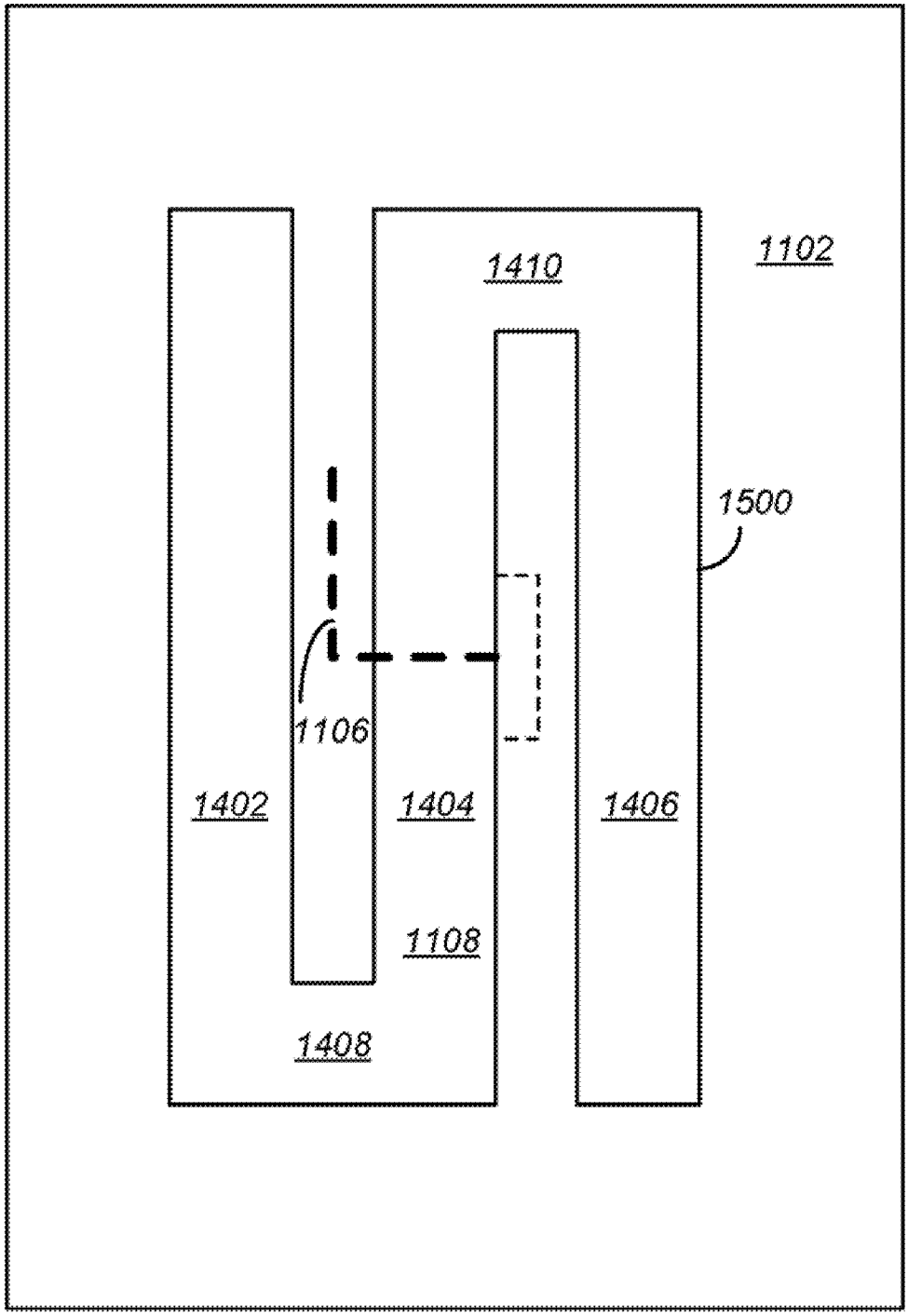
FIG. 15 illustrates an alternate embodiment of the meander slot antenna shown in FIG. 11, wherein the meander slot is wider.

FIG. 15 illustrates a meander slot 1500 having a wider slot than the meander slot 1104 shown in FIGS. 11 & 12. By way of example, all of the slot segments 1502, 1504, 1506, 1508, 1510 have been widened. However, in some embodiments, only a subset of the slot segments might be widened.

Figure 16:
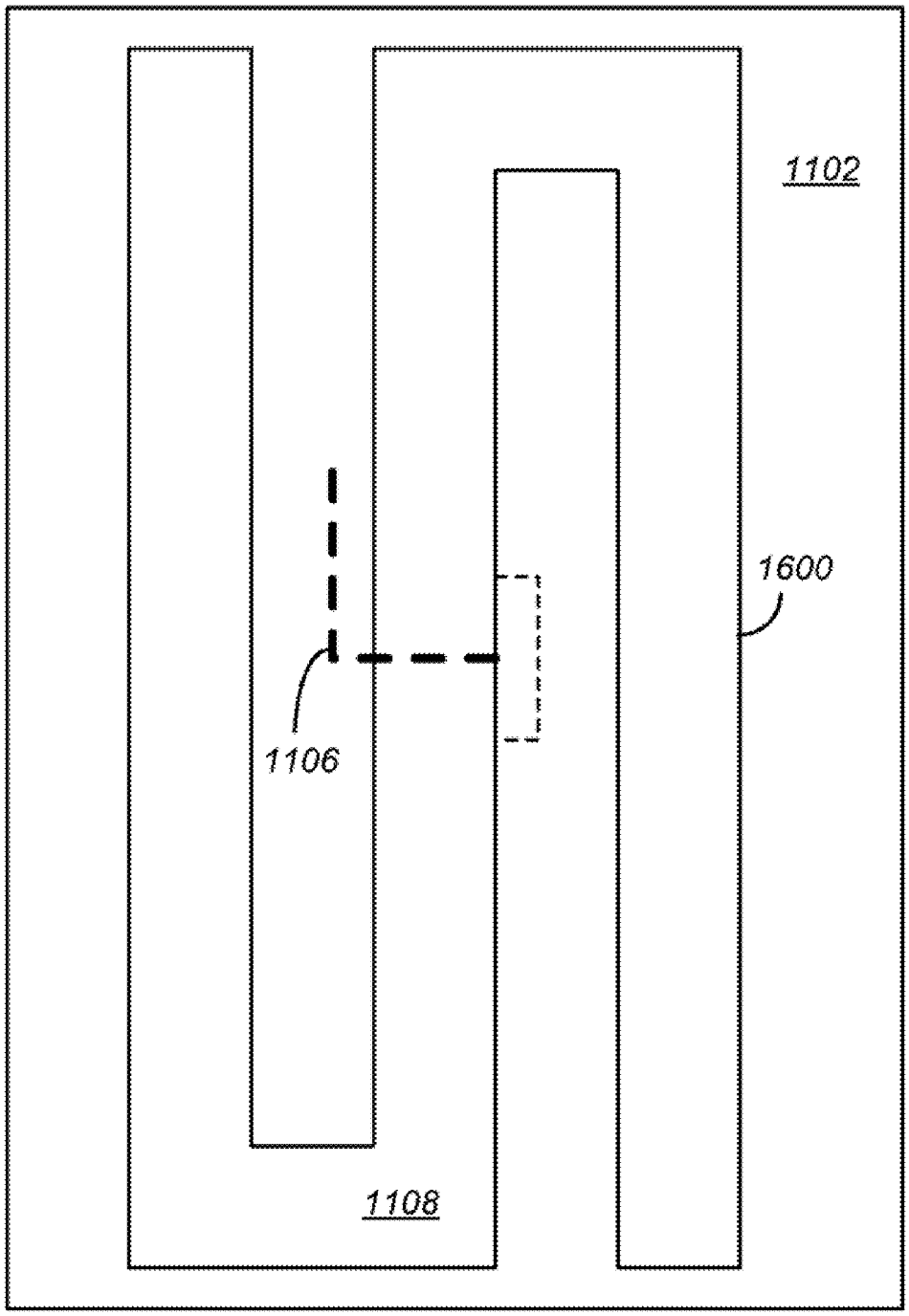
FIG. 16 illustrates an alternate embodiment of the meander slot antenna shown in FIG. 11, wherein the meander slot is longer and wider.

FIG. 16 illustrates a meander slot 1600 having a longer and wider slot than the meander slot 1104 shown in FIGS. 11 & 12.

FIGS. 2-6 illustrate still other configurations of meander slots 200, 300, 400, 500, 600. The meander slots 400, 500, 600 shown in FIGS. 4-6 have different numbers of slot segments compared to the meander slot 1100 shown in FIGS. 11 & 12. In general, the greater the number of slot segments in a meander slot (or really, the more times a meander slot changes direction), the better the meander slot will be at picking up signals of different polarization (e.g., signals of vertical and horizontal polarization).

The meander slots 100, 200, 300, 400, 1100, 1400, 1500, 1600 shown in FIGS. 1-4, 11, 12 & 14-16 are each composed of slot segments having rectangular shapes. However, in some embodiments, one or more of slot segments may have a non-rectangular shape. For example, the meander slots 500, 600 shown in FIGS. 5 & 6 each have a slot segment 502, 602 that has differing widths at two or more points along its length. That is, FIG. 5 has a slot segment 502 having a width that flares out over a portion of its length (e.g., from width W1 to W2), and FIG. 6 has a slot segment 602 that terminates at a point. As with changes in other dimensions of a meander slot, changes in slot segment shape can be used to change the resonant frequency of a meander slot antenna. In addition, slot segments that have flared or varied widths can provide a meander slot antenna with broader bandwidth. This is because narrower width slot segments tend to enable higher frequency operation, and wider width slot segments tend to enable lower frequency operation.

Figure 17:
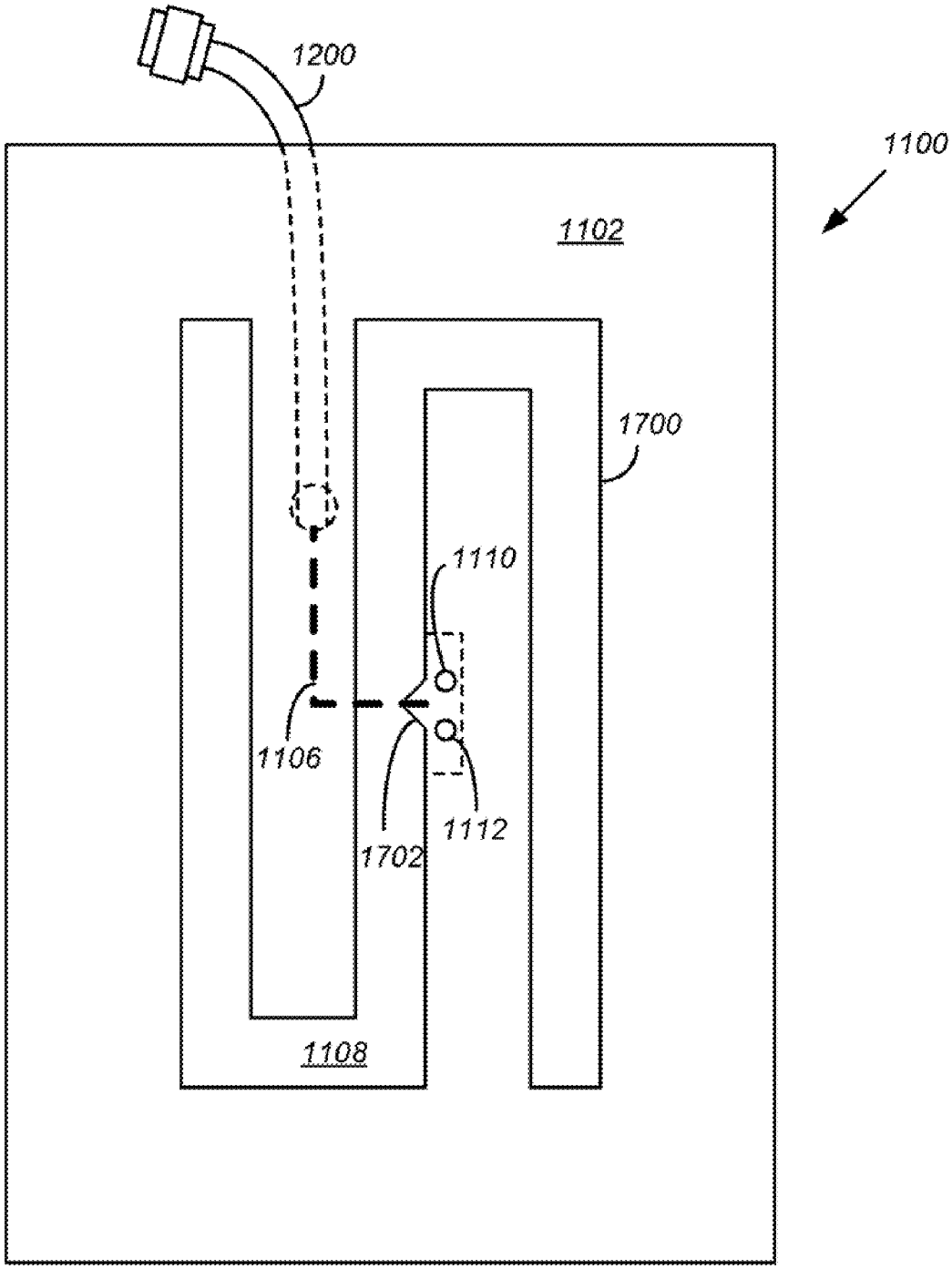
FIG. 17 illustrates an alternate embodiment of the meander slot antenna shown in FIG. 11, wherein the conducting sheet defines a protrusion into the meander slot.

FIG. 17 illustrates an alternate embodiment 1704 of the meander slot 1104 shown in FIG. 11, wherein the conducting sheet 1102 has a protrusion 1702 into the meander slot 1704 defined therein. By way of example, the protrusion 1702 is shown to be triangular (i.e., the protrusion 1702 is a small triangle). However, in alternate embodiments, the protrusion 1702 may take other forms, such as a rectangular or elliptical protrusion. The electrical microstrip feed line 1106 may cross the meander slot 1704 at the protrusion 1702 (i.e., cross the protrusion 1702). The size and shape of the protrusion 1702, as well as the manner in which the electrical microstrip feed line 1106 crosses the protrusion 1702, are factors in determining the LC resonance of the meander slot antenna 1700, and thus the resonant frequency of the antenna 1700. The configuration of the protrusion 1702 can also be used to adjust return loss and bandwidth of the meander slot antenna 1700. Use of the protrusion 1702 is advantageous over implementing a stand-alone capacitor, because it does not result in a significant power draw, and it can eliminate the need for an extra component (i.e., a separate capacitor).

As will be understood by one of ordinary skill in the art, after reading this description, a conducting sheet of a meander slot antenna may define a protrusion of any configuration into a meander slot of any configuration.

Figure 18:
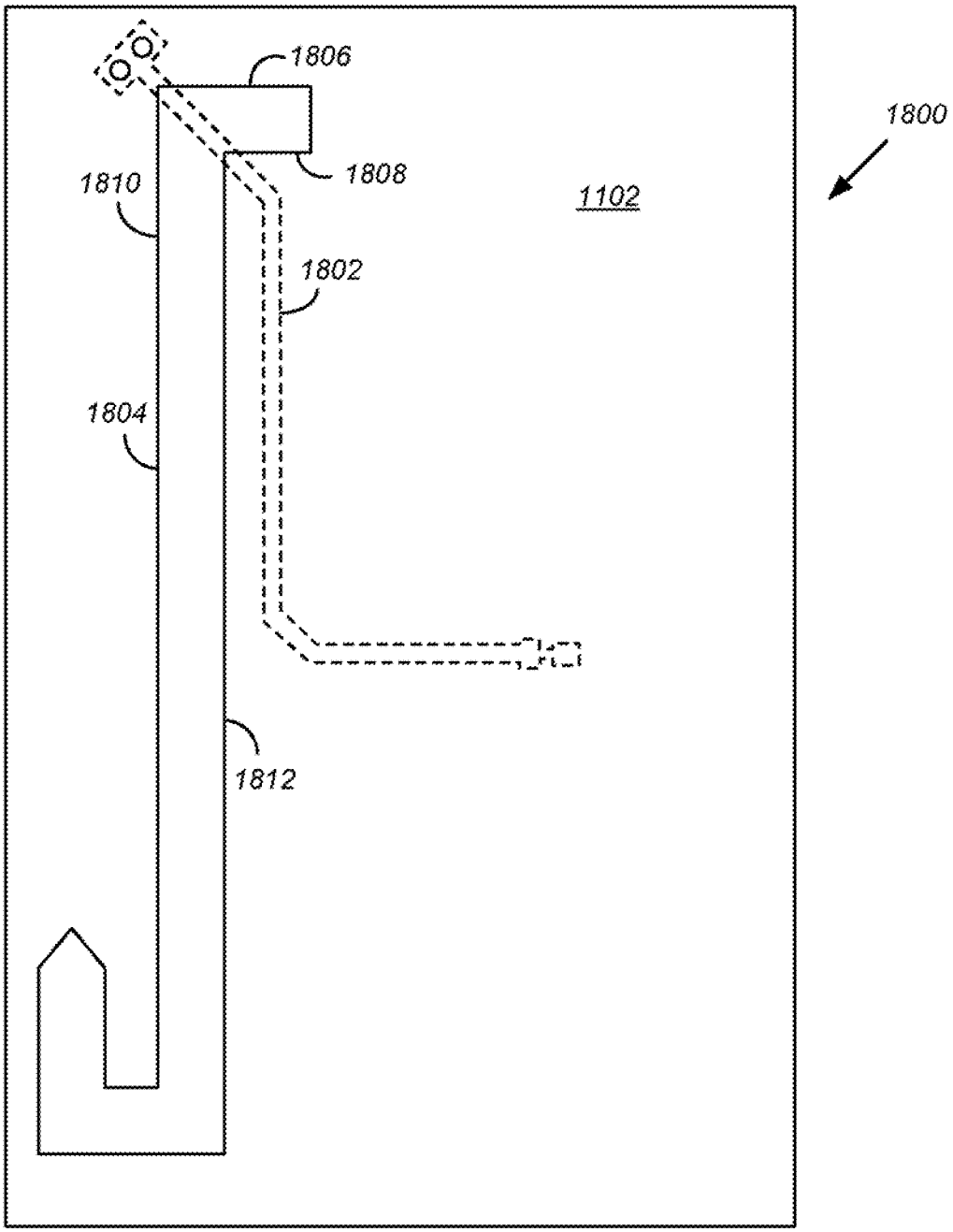
FIG. 18 illustrates an exemplary meander slot antenna having an electrical microstrip feed line that crosses a meander slot at a corner of the meander slot, at an angle other than 90°.

The electrical microstrip feed line 1106 of the meander slot antenna 1100 shown in FIG. 11 crosses first and second sides 1114, 1116 of the meander slot 1104 at 90° angles. However, an electrical microstrip feed line can cross a side of a meander slot at other than a 90° angle, such as a 45° angle. An electrical microstrip feed line can also cross a meander slot at a corner of the meander slot. By altering the angle at which an electrical microstrip feed line crosses a meander slot, the resonant frequency or bandwidth of a meander slot antenna may be changed. By way of example, FIG. 18 illustrates a meander slot antenna 1800 having an electrical microstrip feed line 1802 that crosses a meander slot 1804 at a corner of the meander slot 1804. The electrical microstrip feed line 1802 also intersects various sides 1806, 1808, 1810, 1812 of the meander slot 1804 at a 45° angle.

The resonant frequency of a meander slot antenna can also be changed by altering the location at which an electrical microstrip feed line crosses a meander slot. By way of example, the electrical microstrip feed line 1106 shown in FIG. 11 crosses the meander slot 1104 at a midpoint of the meander slot 1104. However, the electrical microstrip feed line 1802 shown in FIG. 18 crosses the meander slot 1804 close to one end of the meander slot 1804. At times, the same resonant frequency may be obtained with different electrical microstrip feed line and meander slot relationships. However, a particular relationship may provide a higher gain than other relationships.

In the meander slot antennas discussed thus far, each electrical microstrip feed line crosses its corresponding meander slot only once. That is, each electrical microstrip feed line crosses only one of the slot segments of its corresponding meander slot. Sometimes, and as shown in FIGS. 11 & 12, an electrical microstrip feed line 1106 crosses a meander slot 1104 and connects to a conducting sheet 1102 between adjacent ones of a meander slot's slot segments (e.g., between slot segments 1118 and 1120). In such cases, an electrical microstrip feed line 1106 may comprise i) a first section 1122 that crosses one of a plurality of slot segments 1118 of the meander slot, and ii) a second section 1124 that is routed between the adjacent ones of the plurality of slot segments 1118, 1120. In some cases, the second section 1124 may have a different orientation than the first section 1122. Also, in some cases, an electrical microstrip feed line may comprise more than two sections (of different orientation, location, length or width, for example). In this manner, a coax cable connection point to the electrical microstrip feed line 1106 may be positioned such that neither the electrical microstrip feed line nor the coax cable interfere (at least appreciably) with the radiation pattern of the meander slot antenna 1100, but for the intended LC resonance created by the first section 1122 of the microstrip feed line crossing the meander slot 1104.

In some cases, a section of the electrical microstrip feed line 1106, such as the second section 1124 shown in FIG. 11 may extend to outside the footprint of the meander slot 1104; and in some cases, the section 1124 may extend to at or near an edge of the meander slot antenna 1100. Such a routing can make it easier to attach a coax connector to the meander slot antenna 1100, though the use of a solder pad 1202 is still possible.

Still referring to FIG. 11, if a coax cable connection point is located between adjacent slot segments (e.g., between the segments 1118 and 1120) of the meander slot 1104, then steps may be taken to prevent (or at least mitigate the chance of) the coax cable inadvertently crossing the meander slot 1104. These steps may include, for example: soldering the coax cable to the electrical microstrip feed line 1106 at a solder pad 1202 such that solder holds the coax cable in a predetermined position; or providing one or more fasteners or clips to hold the coax cable at a desired position with respect to the meander slot antenna 1100.

The second section 1124 of the microstrip feed line 1106 may provide, for example, a 50Ω connection at a desired frequency. The configuration of the electrical microstrip feed line 1106, and particularly the second section 1124, can also be used to adjust the return loss (i.e., SWR) of the meander slot antenna 1100 over a desired frequency. The lower the return loss, the more energy is transferred to the meander slot 1104. The higher the return loss, the more energy is reflected back to the transmitter, providing less energy to the meander slot 1104, and making the meander slot antenna 1100 less efficient. Return loss may be adjusted by changing the length and width of one or more sections of the microstrip feed line 1106, such as section 1124. However, return loss may also be adjusted, for example, by providing and configuring the dimensions of one or more electrical microstrip stubs (e.g., tuning stubs) off of the electrical microstrip feed line 1106.

Figure 19:
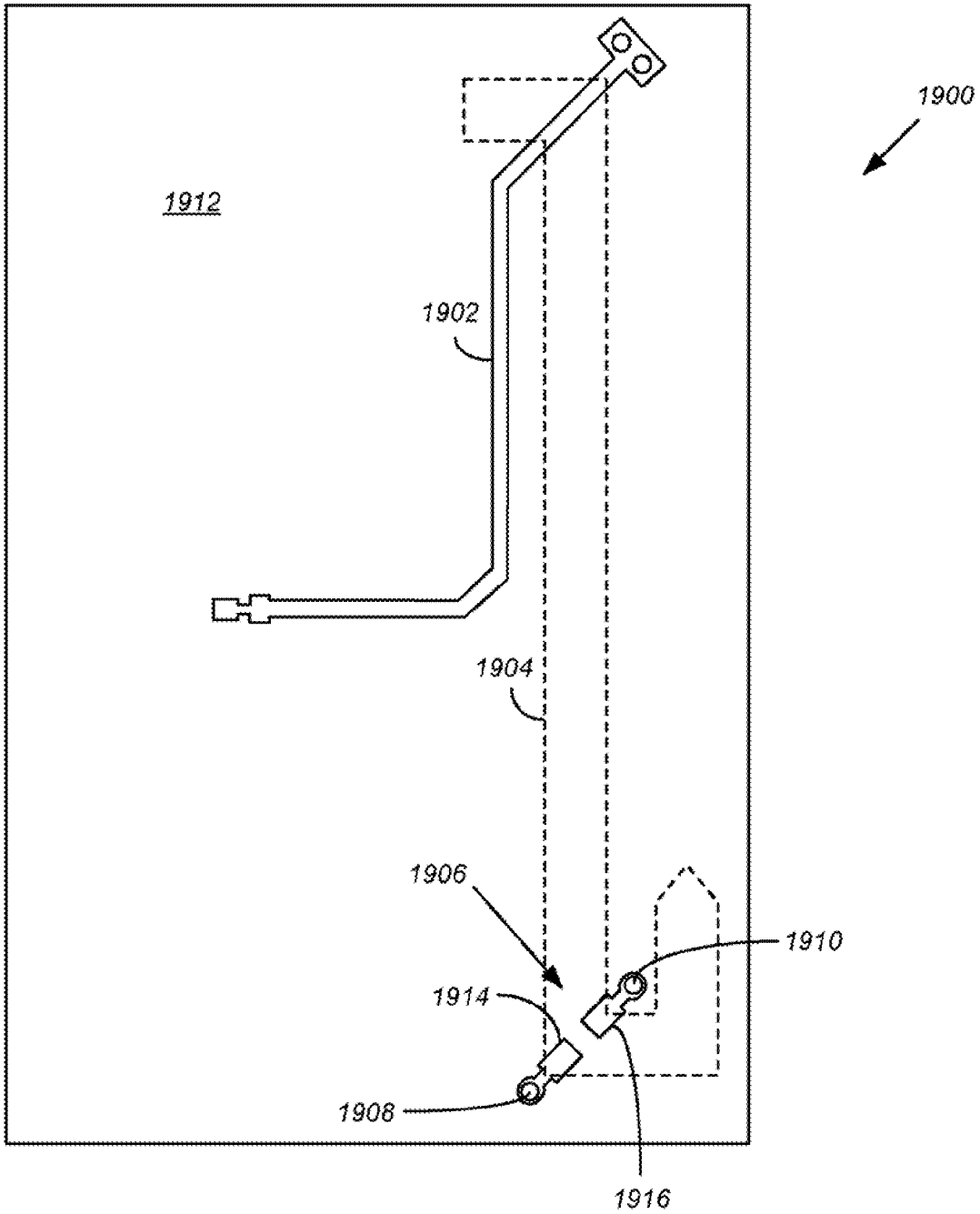
FIG. 19 illustrates an exemplary way to add a capacitor to the meander slot antenna shown in FIG. 18.

FIG. 19 illustrates the back side of a meander slot antenna 1900 having a slot 1904 shaped similarly to the slot 1804 shown in FIG. 18. However, the exemplary meander slot antenna 1900 shown in FIG. 19 comprises a capacitor 1906. The capacitor 1906 has first and second terminals 1908, 1910 that are coupled to a conductive sheet on the front side of the meander slot antenna 1900. By way of example, the first and second terminals 1908, 1910 may take the form of vias through a dielectric material 1912. The capacitor 1906 further comprises first and second spaced plates 1914, 1916 (e.g., pads), which plates 1914, 1916 are formed on the back side of the meander slot antenna 1900, opposite the side of the antenna 1900 on which the meander slot 1904 is formed. Each of the first and second spaced plates 1914, 1916 projects across the meander slot 1904. The dielectric material 1912 separates the conducting sheet in which the meander slot 1904 is formed from the first and second plates 1914, 1916, but for where the plates 1914, 1916 are coupled to the conducting sheet via the first and second terminals 1908, 1910. The capacitor 1906 provides an additional mechanism for defining the LC constant and resonant frequency of the meander slot antenna 1900 (e.g., the size and spacing of the plates 1914, 1916 may be adjusted to change the capacitance provided by the capacitor 1906). In some embodiments, the plates 1914, 1916 of the capacitor 1906 could be made larger or smaller, or could be provided with different shapes. Also, the terminals 1908, 1910 of the capacitor 1906 need not be directly opposed from one another across the slot 1904. That is, the terminals 1908, 1910 of the capacitor 1906 could be staggered with respect to the meander slot 1904, such that the plates 1914, 1916 of capacitor 1906 cross the meander slot 1904 at different angles, or such that the capacitance of the capacitor 1906 is increased. Also, some embodiments of a meander slot antenna can be associated with more than one capacitor.

Figure 20:
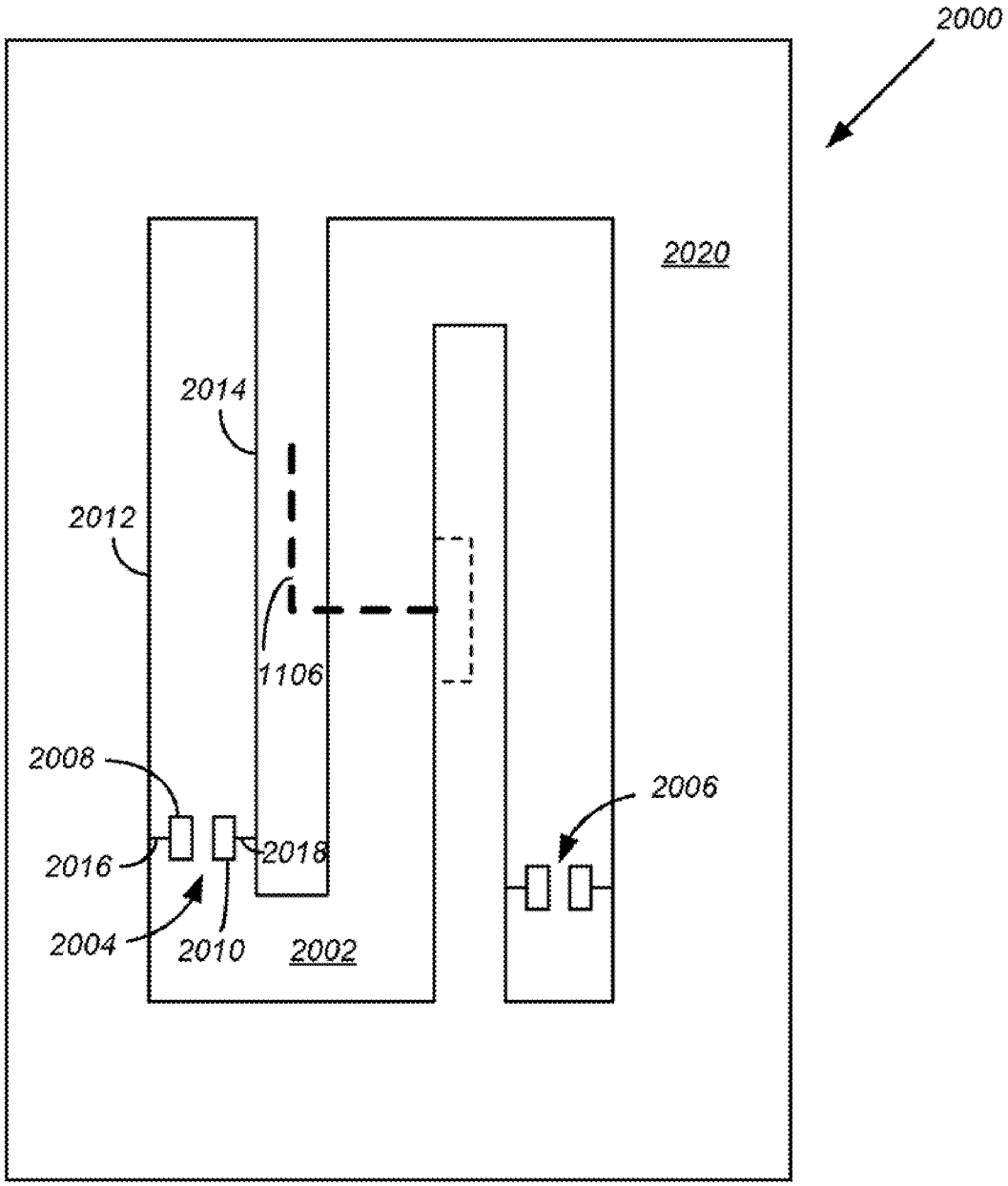
FIG. 20 illustrates an exemplary way to add capacitors to the meander slot antenna shown in FIG. 15.

FIG. 20 illustrates the front side of a meander slot antenna 2000 having a meander slot 2002 shaped similarly to the slot 1108 shown in FIG. 15. However, the exemplary meander slot antenna 2000 comprises a pair of capacitors 2004, 2006 formed across the meander slot 2002. Each of the capacitors 2004, 2006 may be formed in a similar manner, though they need not be. By way of example, the capacitor 2004 comprises first and second plates 2008, 2010 (e.g., pads), each of which is coupled to a respective side 2012 or 2014 of the meander slot 2002 (e.g., by respective traces 2016, 2018), and each of which is defined by the conducting sheet 2020. As shown, each of the first and second spaced plates 2008, 2010 projects into the meander slot 2002. In some embodiments, the plates 2008, 2010 of the capacitor 2004 could be made larger or smaller, or could be provided with different shapes. Also, the plates 2008, 2010 of the capacitor 2004 need not be connected to directly opposite points across the slot 2002. That is, the plates 2008, 2010 of the capacitor 2004 could be connected to staggered points along the sides 2012, 2014 of the meander slot 1904, or the plates 2008, 2010 could be connected at or near corners of the meander slot 2002. In some cases, the capacitor 2004 is advantageous over the capacitor 1906 (FIG. 19) in that the capacitor 2004 can be formed in the conducting sheet 2020 in parallel with, or via the same process as, the meander slot 2002. Similarly to the capacitor 1906, the capacitors 2004 and 2006 provide additional mechanisms for defining the LC constant and resonant frequency of the meander slot antenna 2000 (e.g., the size and spacing of the plates 2008, 2010 may be adjusted to change the capacitance provided by the capacitor 2004).

FIGS. 19 & 20 illustrate exemplary ways to associate a capacitor 1906, 2004 or 2006 with a meander slot. In a particular meander slot configuration, one or more of these or other types of capacitors may be associated with a meander slot, to provide a further element for adjusting the LC constant and resonant frequency of a meander slot antenna. It is noted that the location(s) of one or more capacitors also affect the LC constant and resonant frequency of a meander slot antenna, as well as the bandwidth of a meander slot antenna. In some cases, capacitors of different types may be associated with a single meander slot. In some cases, one of the plates of a capacitor may be a side of the meander slot.

The capacitor forming techniques disclosed with respect to FIGS. 19 & 20 are not limited to meander slot antennas. For example, any of the capacitors 1906, 2004, 2006 shown in FIGS. 19 & 20 could be implemented in conjunction with a rectangular slot, elliptical slot or other type of slot antenna.

Having discussed various configurations of a meander slot, alternate configurations of an electrical microstrip feed line will now be discussed.

In the meander slot antennas shown in FIGS. 11-20, the electrical microstrip feed lines are of uniform width, though some of the electrical microstrip feed lines change direction so that they can be routed between adjacent segments of a meander slot.

The use of an electrical microstrip feed line provides a precision resonant frequency for a meander slot antenna. In one embodiment, that frequency may be around 2.4 GHz. In other embodiments, and by way of example, a meander slot antenna may be configured with a 200 MHz or 400 MHz wide band between 2.3 GHz-2.5 GHz or 2.3 GHz-2.7 GHz, respectively, a 500 Mhz wide band between 3.3 GHz-3.8 GHz, a 1 Mhz wide band between 4.9 GHz-5.9 GHz, or a 1.32 Ghz wide band between 3.168 GHz-4.488 Ghz. The bandwidths of these and other meander slot antenna designs can be achieved, in part, by raising or lowering the q-factor, which in turn is dependent on the resistance of an antenna's electrical microstrip feed line. Generally, the q-factor is enhanced, and bandwidth is increased, by providing at least the portion of the electrical microstrip feed line that crosses the meander slot with a lower resistance. Similarly, the bandwidth of a meander slot antenna is generally decreased by providing at least the portion of the electrical microstrip feed line that crosses the meander slot with a higher resistance.

Figure 21:
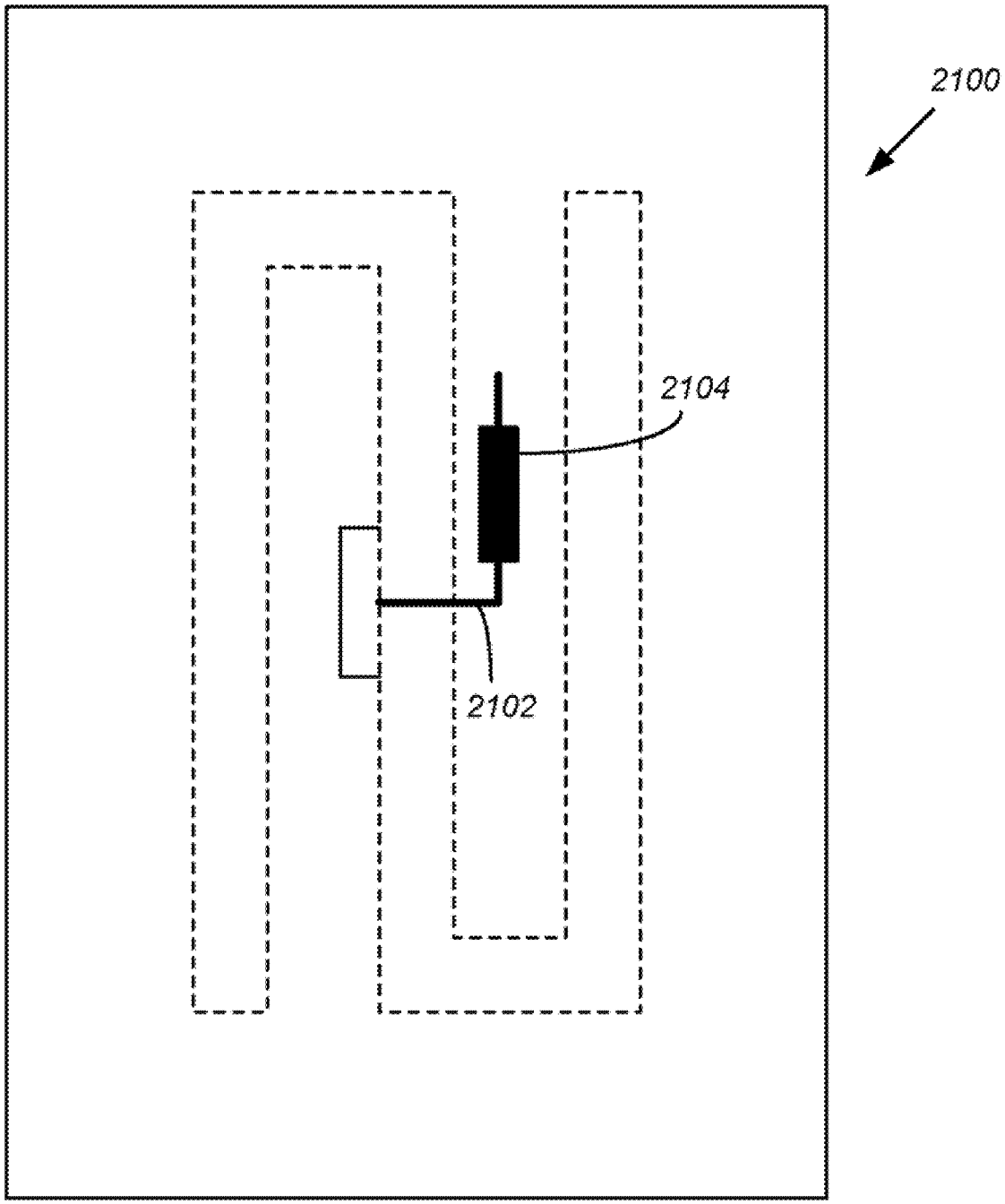
FIG. 21 illustrates an exemplary meander slot antenna having a trace of a different width applied over an electrical microstrip feed line.
Figure 22:
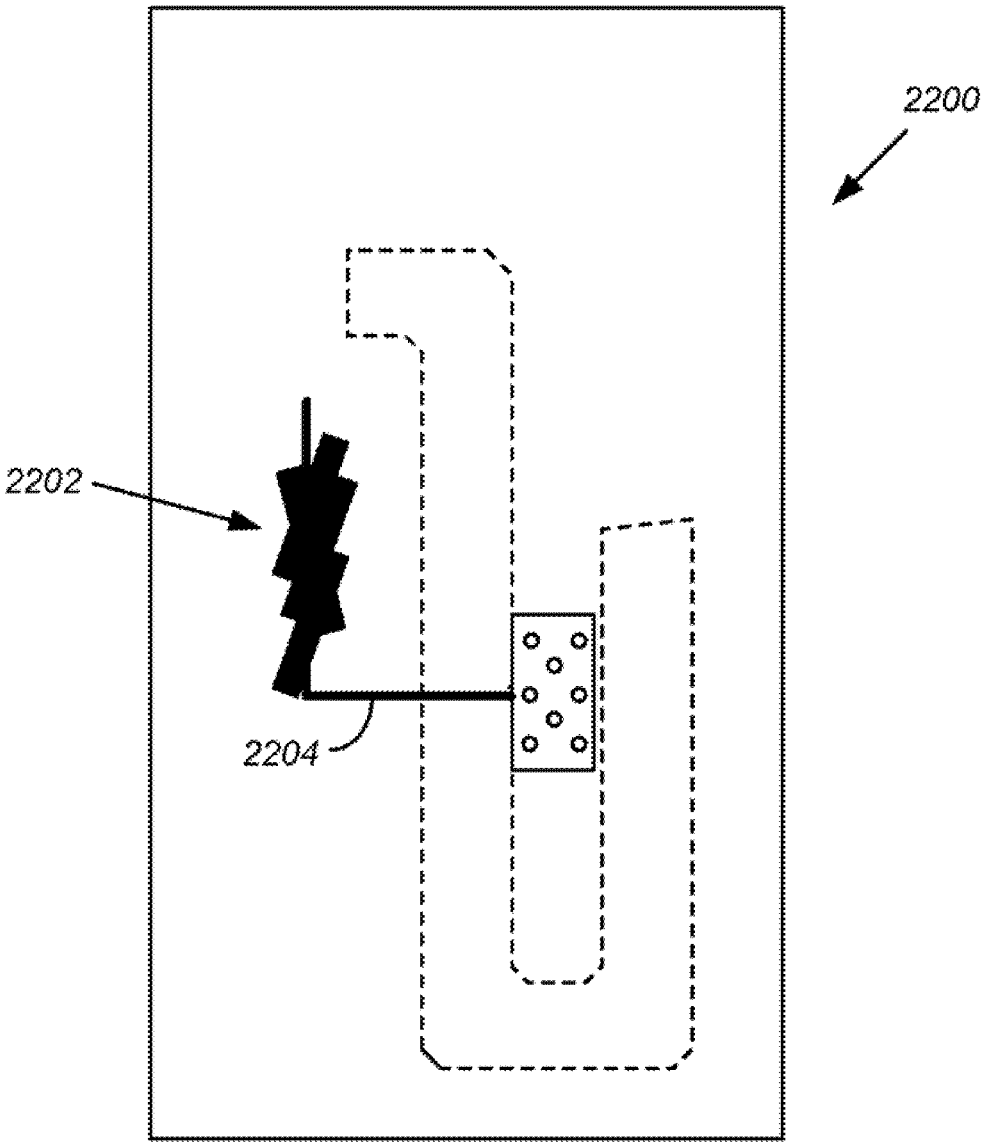
FIG. 22 illustrates an exemplary meander slot antenna having multiple traces of different orientation applied over an electrical microstrip feed line.

The resistance of an electrical microstrip feed line can be changed in a variety of ways. In some embodiments, the resistance may be increased by simply widening the feed line; or, alternatively, the resistance may be decreased by narrowing the feed line. In other embodiments, one or more layers of traces may be applied over one or more portions of the electrical microstrip feed line. For example, FIG. 21 shows a meander slot antenna 2100 having 1) an electrical microstrip feed line 2102 that has a first width, and 2) a trace 2104 applied over a portion of the electrical microstrip feed line 2102, which trace 2104 has a second width greater than the first width. The wider trace 2104 may be applied over a larger or shorter length portion of the electrical microstrip feed line 2102. Alternately, multiple wider or narrower traces (collectively labeled 2202) may be applied over one or more portions of an electrical microstrip feed line 2204, as shown in the meander slot antenna 2200 of FIG. 22. Traces may be applied over (or under) an electrical microstrip feed line by centering the traces on the electrical microstrip feed line, as shown, for example, in FIG. 21, or by orienting the traces in different and possibly multiple directions, as shown, for example, in FIG. 22. Multiple traces may or may not overlap one another. In some cases, the traces can be applied over one another (or over the electrical microstrip feed line) in separate process steps. In other cases, a single electrical microstrip feed line having a desired configuration (which configuration may have portions of different widths or shapes) may be cut, formed or applied in a single process step (or in a series of process steps that results in the configuration of the electrical microstrip feed line being formed at once).

The performance of meander slot antennas can vary. However, given a current fed meander slot antenna and a current fed rectangular slot antenna, each having a slot of similar area, the meander slot antenna will typically provide higher gain and take up less space than the rectangular slot antenna. Put another way, a current fed meander slot antenna may in some cases be manufactured at about half the size (e.g., 49.4 percent of the size, in one example) of a current rectangular slot antenna having equivalent gain and bandwidth. The high gain of meander slot antennas can therefore be leveraged, for example, to increase the range of an antenna, to reduce the size of an antenna, or to reduce the power requirements of a device in which the antenna is used (e.g., save battery power).

Current fed meander slot antennas are also useful because of their ability to detect both horizontally and vertically polarized signals, which can offer improved signal strength. As a result, current fed meander slot antennas are well suited for applications that require high gain in a noisy multipath environment. For example, meander slot antennas can be advantageous indoors, where antennas get bombarded by waves that have become multiplied by bounces off walls and ceilings, and where waves coming from all directions can mask the primary signal.

Figure 23:
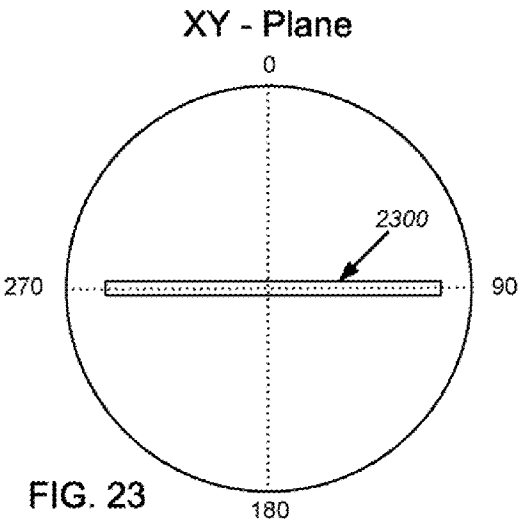
FIGS. 23-25 illustrate various planes of an exemplary rectangular slot antenna.
Figure 24:
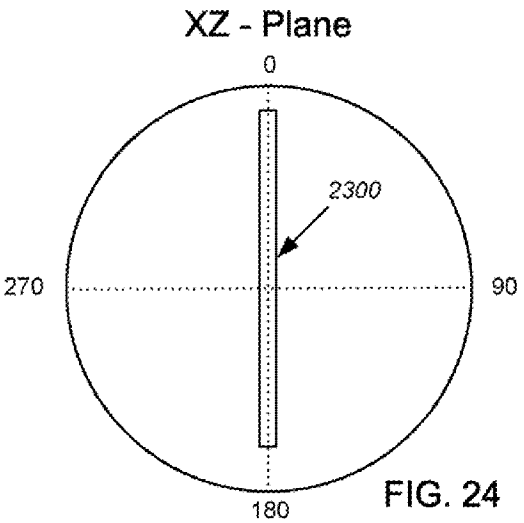
Figure 25:
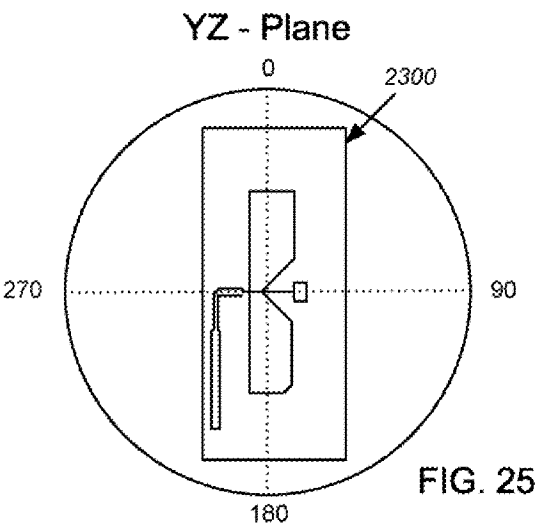

The exemplary comparative performance of a current fed meander slot antenna and a current fed rectangular slot antenna will now be described. By way of example, consider the current fed rectangular slot antenna 2200 shown in FIGS. 23-25 and the current fed meander slot antenna 2600 shown in FIG. 26-28. The dimensions of the meander slot antenna are 46 mm high×28 mm wide×1.6 mm thick, and the conducting sheet of the antenna is formed of copper. The frequency range of the antenna is 2400-2483.5 MHz; the V.S.W.R. (Min) is 2.5:1; the gain (Max) is 3.2 dBi±1; the input impedance is 50 CI; and the polarization is linear. In one particular experiment, the vertical (primary) and horizontal (secondary) gain components were measured for each antenna at three different frequencies. See, for example, the gain data provided in the table shown in FIG. 29. For each gain component, the measured gains were averaged. As one can see form the table shown in FIG. 29, the primary gain of the meander slot antenna was approximately half that of the rectangular slot antenna. However, when total gain is considered (e.g., vertical gain+horizontal gain), one can see that the total gain of the meander slot antenna is approximately 26 times that of the rectangular slot antenna. This is because radio frequency signals in a multipath environment contain both vertical and horizontal components, and the different orientations of the meander slot's segments are better able to transmit and receive both polarizations (e.g., vertical and horizontal polarizations).

Figure 30:
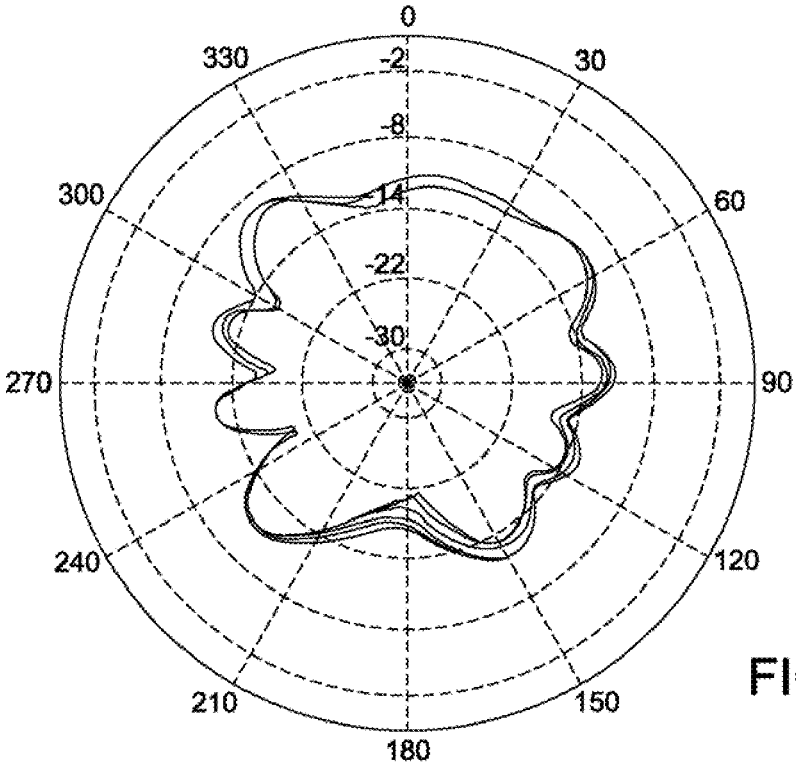
FIGS. 30 & 31 are polar plots of azimuth patterns for the rectangular slot antenna shown in FIGS. 23-25.
Figure 31:
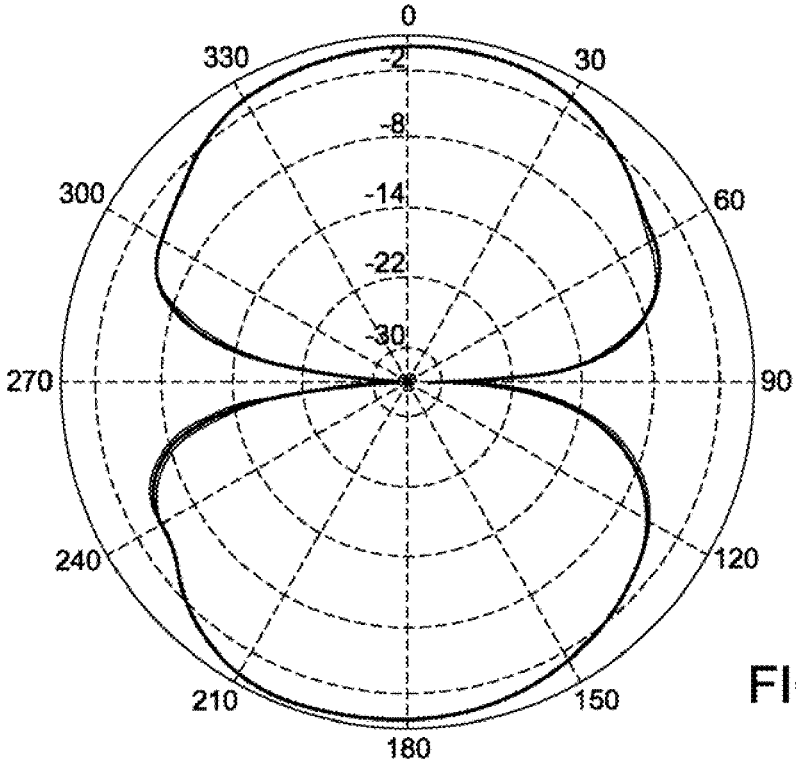
Figure 32:
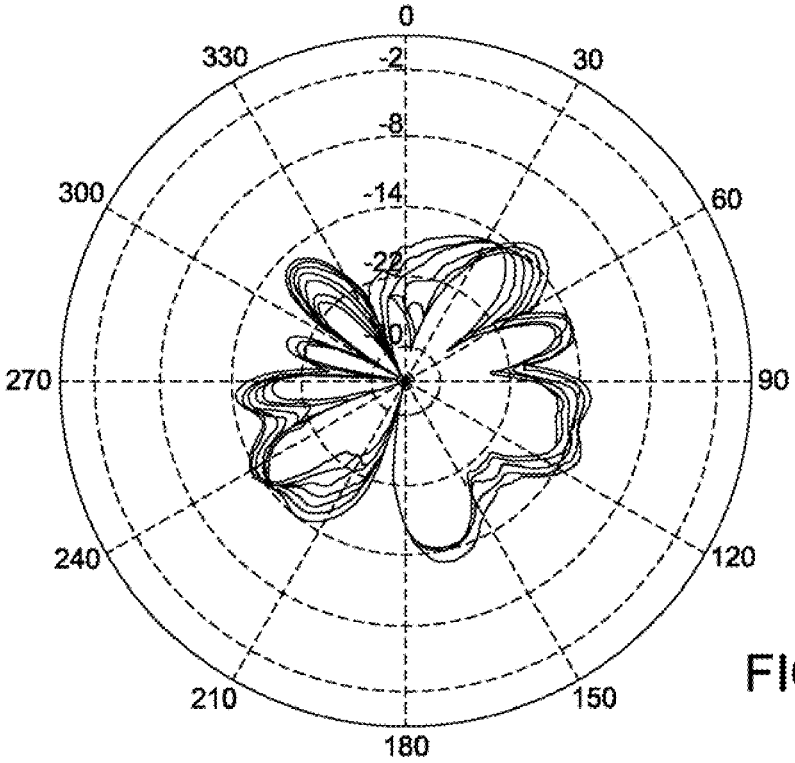
FIGS. 32 & 33 are polar plots of elevation patterns for the rectangular slot antenna shown in FIGS. 23-25.
Figure 33:
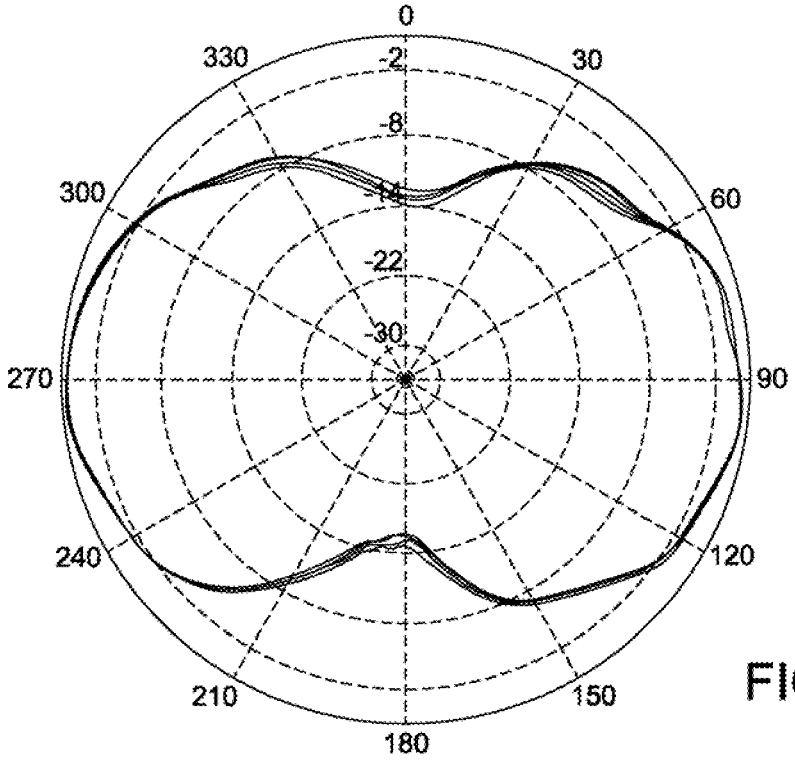
Figure 34:
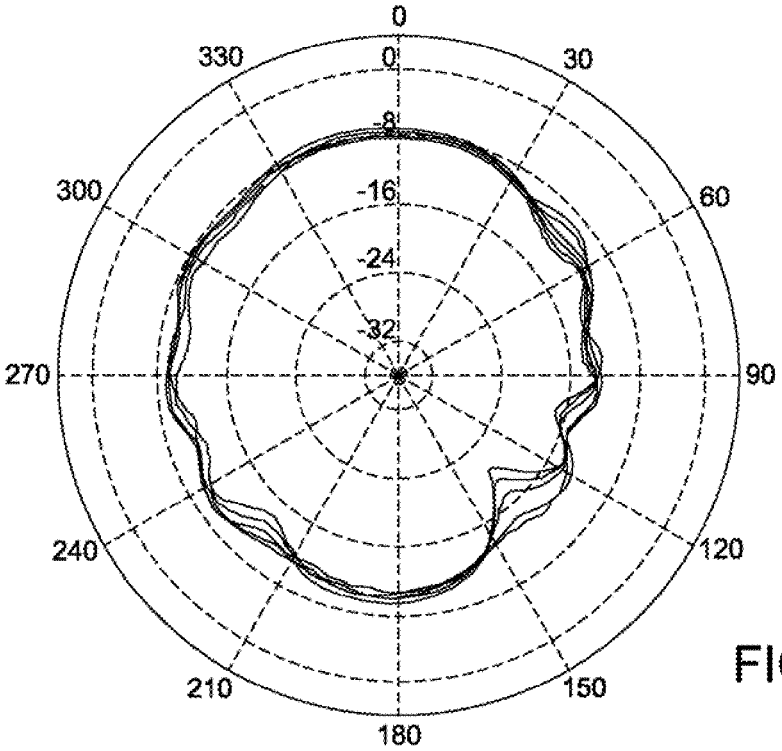
FIGS. 34 & 35 are polar plots of azimuth patterns for the meander slot antenna shown in FIGS. 26-28.
Figure 35:
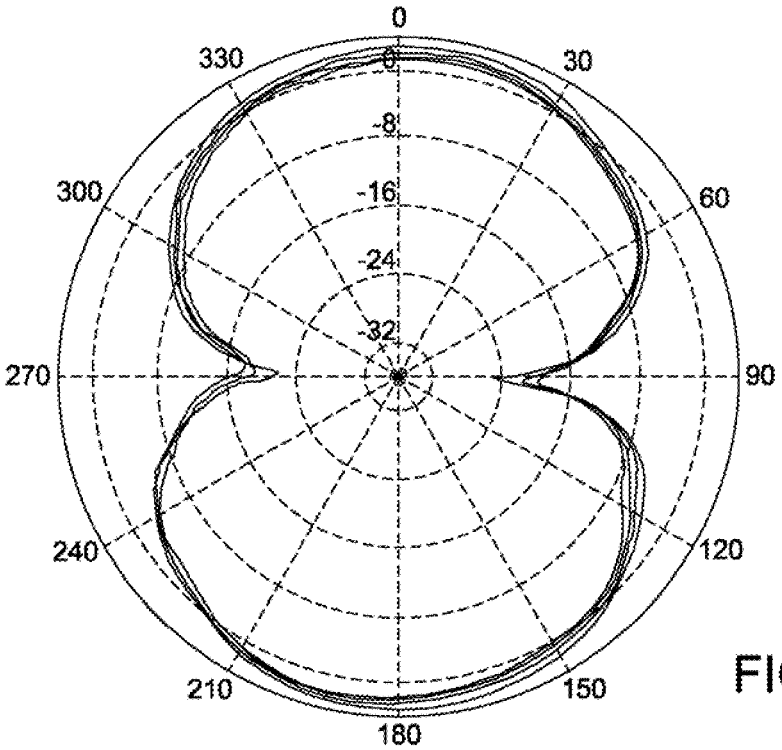
Figure 36:
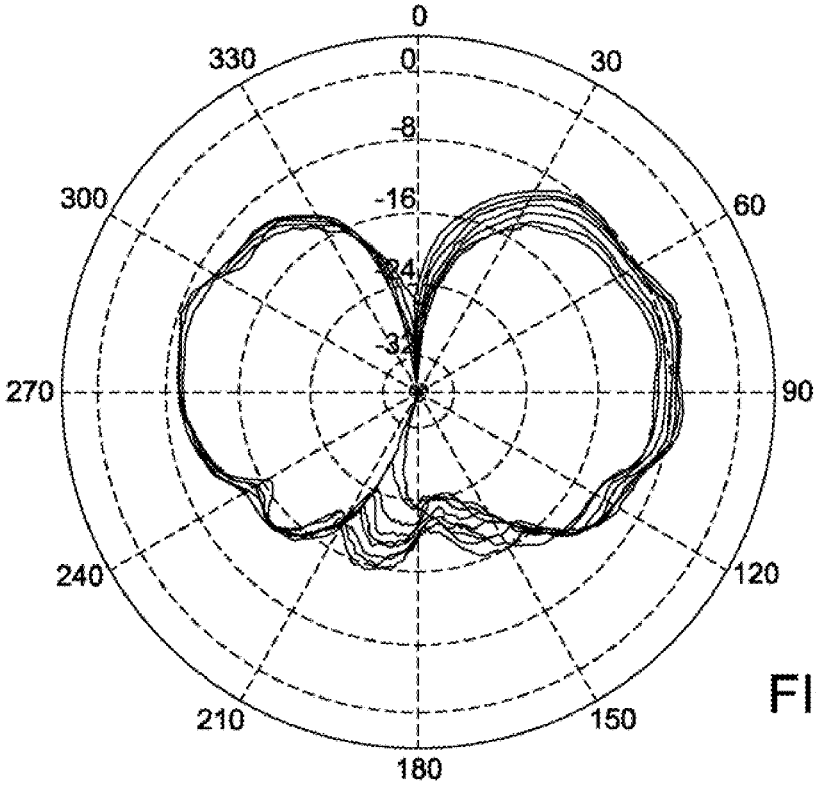
FIGS. 36 & 37 are polar plots of elevation patterns for the meander slot antenna shown in FIGS. 26-28.
Figure 37:
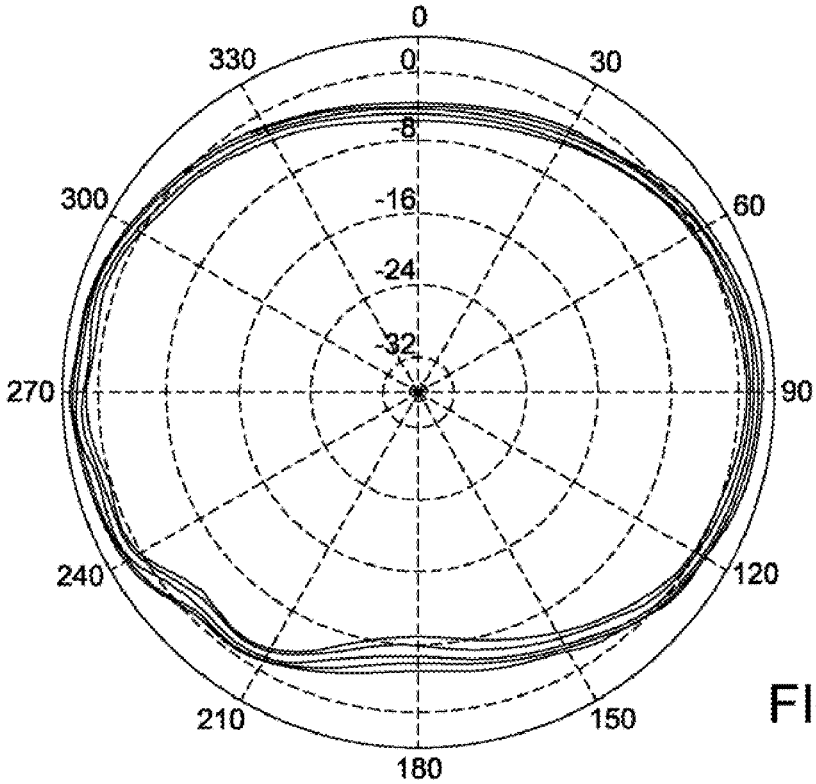

FIGS. 30-37 illustrate various polar plot measurements for the rectangular and meander slot antennas 2300, 2600 shown in FIGS. 23-25 and FIGS. 26-28. FIGS. 30 & 31 illustrate azimuth patterns (in the XY plane) for the rectangular slot antenna, with FIG. 30 illustrating the vertical component of the azimuth and FIG. 31 illustrating the horizontal component of the azimuth. FIGS. 32 & 33 illustrate elevation patterns (in the XZ plane) for the rectangular slot antenna, with FIG. 32 illustrating the vertical component of the elevation and FIG. 33 illustrating the horizontal component of the elevation. FIGS. 34 & 35 illustrate azimuth patterns (in the XY plane) for the meander slot antenna, with FIG. 34 illustrating the vertical component of the azimuth and FIG. 35 illustrating the horizontal component of the azimuth. FIGS. 36 & 37 illustrate elevation patterns (in the XZ plane) for the meander slot antenna, with FIG. 36 illustrating the vertical component of the elevation and FIG. 37 illustrating the horizontal component of the elevation.

One can graphically see the difference between vertical and horizontal gain components for each of the azimuth and elevation patterns shown in FIGS. 30-37. One can also see the larger difference between vertical and horizontal gain components for the rectangular slot antenna 2300 versus the meander slot antenna 2600.

Figure 27:
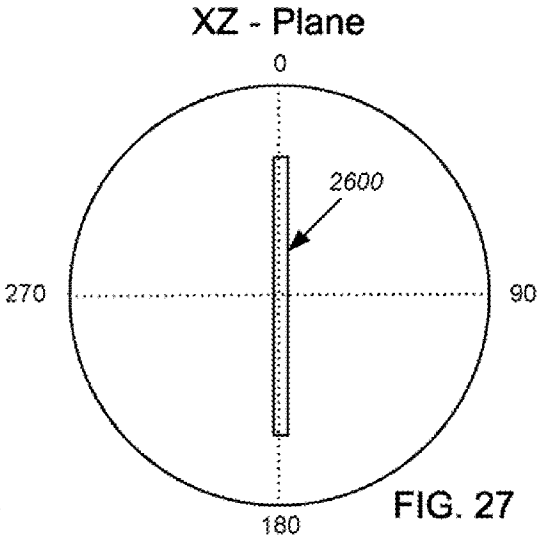
FIGS. 26-28 illustrate various planes of an exemplary meander slot antenna.
Figure 26:
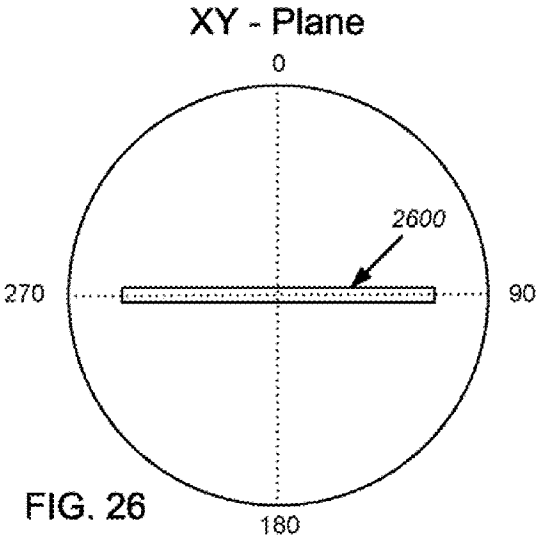
Figure 28:
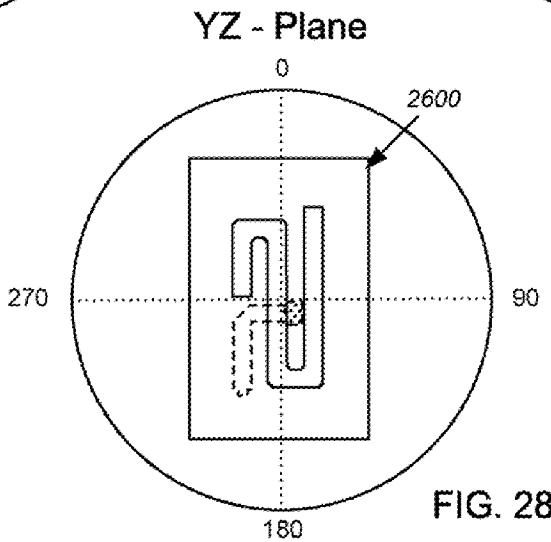
Figure 38:
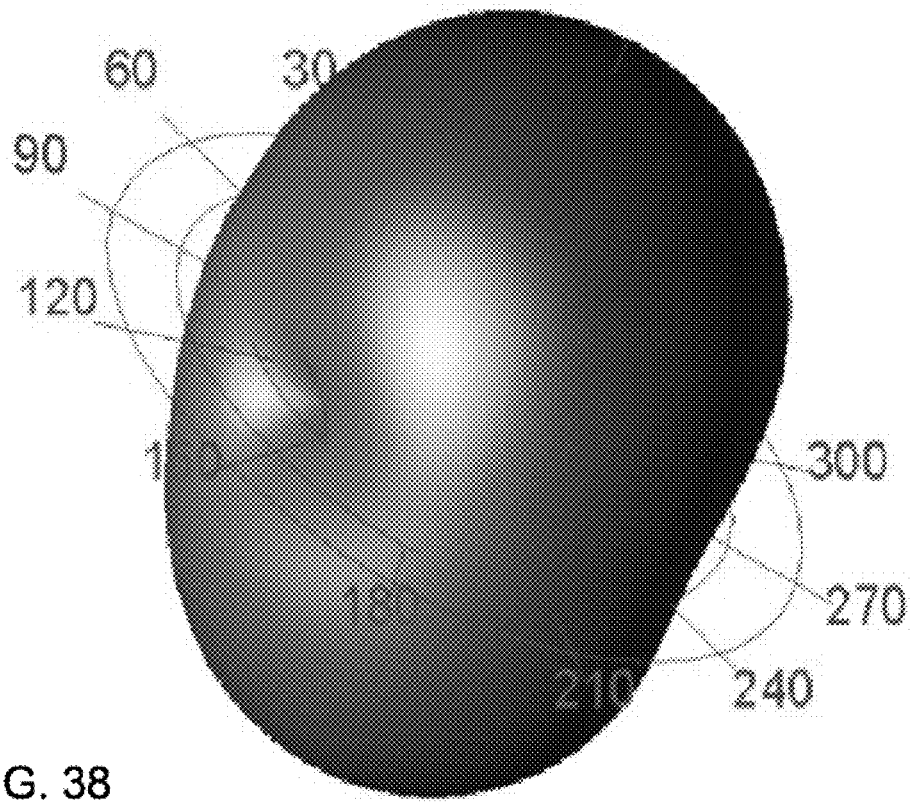
FIG. 38 illustrates a 3D summation of the azimuth and elevation polar plots for the meander slot antenna shown in FIGS. 26-28.

FIG. 38 illustrates a 3D summation of the azimuth and elevation polar plots for the meander slot antenna 2600 shown in FIGS. 26-28. The XY plane of the meander slot antenna 2600 is presumed to be positioned on the plane of the polar grid shown in FIG. 38. As can be seen, the meander slot antenna 2600 has maximum gain in directions perpendicular to the plane of the antenna, but also has significant gain over the top, bottom and sides of the antenna. As a result, the total gain of the meander slot antenna 2600 forms a nearly spherical pattern about the antenna.

In some cases, multiple slots may be formed in the conducting sheet of a meander slot antenna. That is, some antennas may have more or fewer slots of arbitrary number. However, when multiple slots are used, it is usually preferable to arrange the slots such that they complement each other in a phased array pattern. Each time the number of slots in a phased array is doubled, the gain of the phased array can be increased by 3 dBi.

Figure 39:
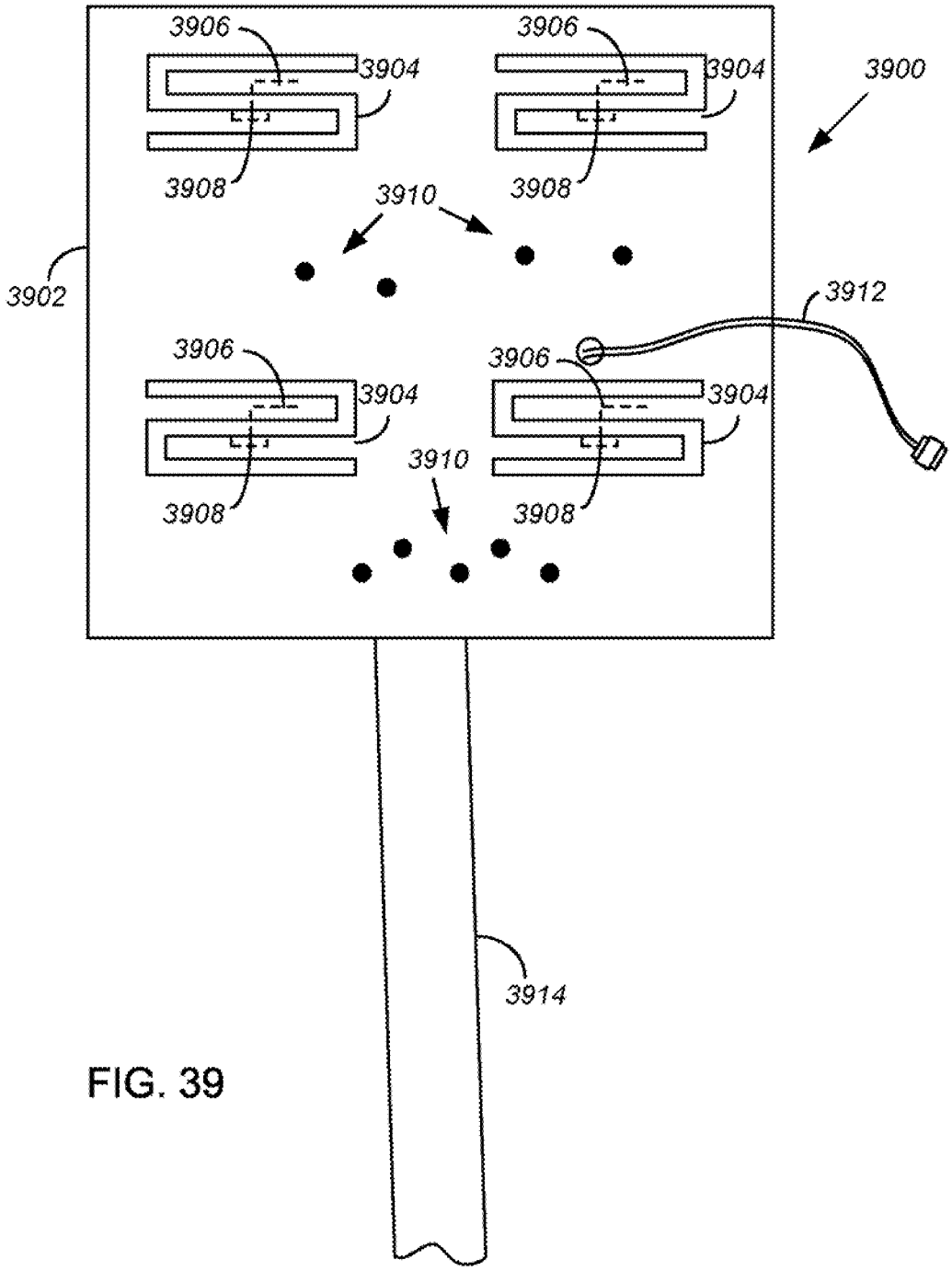
FIG. 39 illustrates a front view of an exemplary high gain steerable phased array antenna that employs meander slot antennas.
Figure 40:
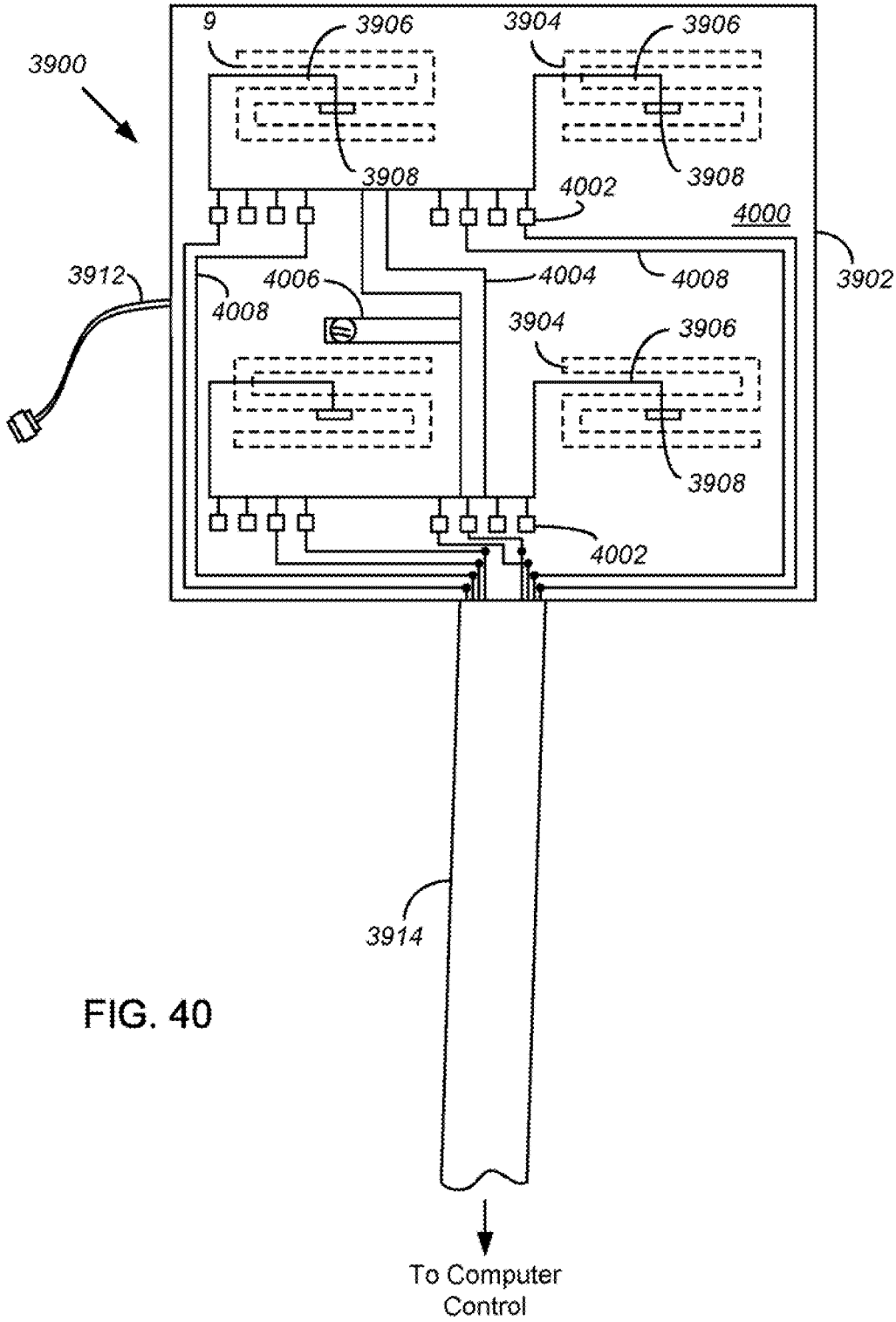
FIG. 40 illustrates a back view of the high gain steerable phased array antenna shown in FIG. 39.

In some phased array antennas, a conducting sheet 3902 may have a plurality of (i.e., two or more) meander slots 3904 defined therein. See, for example, the phased array antenna 3900 shown in FIGS. 39 & 40, where FIG. 39 illustrates the front side of the antenna 3900 and FIG. 40 illustrates the back side of the antenna 3900. By way of example, the phased array antenna 3900 is provided with four meander slots 3904, though more or fewer meander slots 3904 could be provided. Respective ones of a plurality of electrical microstrip feed lines 3906 cross each of the meander slots 3904 to form a plurality of magnetically coupled LC resonance elements. The electrical microstrip feed lines 3906 are generally separated from the conducting sheet 3902 by a dielectric material 4000 (FIG. 40). However, each electrical microstrip feed line 3906 is coupled to its respective meander slot 3904 by a number of vias in the dielectric material (in areas 3908). The locations of the connections between the electrical microstrip feed lines 3906 and the meander slots 3904 may vary, depending on the configurations of the meander slots 3904 and electrical microstrip feed lines 3906, and depending on the desired resonant frequency, bandwidth and gain of the phased array antenna 3900. Sometimes, resonance of a meander slot 3904 can be achieved by routing its electrical microstrip feed line 3906 across it at different locations or orientations. However, it is often the case that one of the locations and orientations will provide a higher gain.

A coax cable 3912 may be connected to the electrical microstrip feed lines 3906 by soldering or other means. Likewise, a signal cable 3910 may be connected to delay circuitry positioned on the back side of the phased array antenna 3900, as will be discussed more fully with respect to FIG. 40. The black circles in FIG. 39 illustrate other connections between the conducting sheet 3902 and circuitry on the back side of the antenna 3900.

FIG. 40 illustrates the back side of the phased array antenna 3900 shown in FIG. 39. This side of the antenna 3900 includes a circuit board 4000 with various electrical connections. The meander slots 3904 that are cut into the conducting sheet 3902 at the front side are shown in dotted lines in FIG. 40, for perspective as to their relative location to the electrical components on the back side.

The resonant meander slots 3904 are fed in parallel by the electrical microstrip feed lines 3906. To enable steering of the phased array antenna 3900, each of the electrical microstrip feed lines 3906 is connected to a series of electronic circuitry components 4002. In FIG. 40, each electrical microstrip feed line 3906 is connected to four of these components 4002, which are illustrated as squares. These components provide electronic delays that permit the antenna 4000 to be directionally steered. In some embodiments, the components 4002 may include PIN diodes and inductors. The diodes may be of type diode PIN 60V 100 mA S mini-2P by Panasonic SSG (MFG P/N MA2JP0200L; digikey MA2JP0200LTR-ND), or Shottky diode, Agilent p/n HSMS-2850 or equivalent. The inductors may be of type 1.0 .mu.H+/−5% 1210 by Panasonic (MFG P/N ELJ-FA1R0JF2; digikey PCD1825TR-ND). Capacitors may be 1000 pF, TDK, C1608X7R1H102K or equivalent. Resistors may be 470 ohms, Yaego 9C06031A4700JLHFT or equivalent.

The antenna 4000 is electronically steered by selectively adding the delay circuitry 4002 to the electrical microstrip feed lines 3906. The delays change the phases of the signals on the electrical microstrip feed lines 3906. In some embodiments, each component 3902 of the delay circuitry includes a PIN diode and a pad cut into the metal layer of a circuit board. When the PIN diode is turned on, delay is added to the circuit. This means that it can be used to follow the source of the signal. By way of example, the signal can originate from a wireless access point, a portable computer, or another device.

The electrical microstrip feed lines 3906 each connect to a main feed line 4004. The two electrical microstrip feed lines 3906 in the upper half of the antenna 4000 of FIG. 40 are connected to the upper half of the main feed line 4004, and the two electrical microstrip feed lines 3906 in the lower half of the antenna 4000 of FIG. 40 are connected to the lower half of the main feed line 4004. The main feed line 4004 is connected at its center to a coax connection segment 4006 that is connected to the coax cable 3912. Various traces 4008 are shown connecting the delay pads 4002 to the signal cable 3914. The signal cable 3914, in turn, connects to computer operated control equipment.

The antenna 4000 shown in FIGS. 39 & 40 has four resonant meander slots 3904. The top and bottom halves of the antenna 4000 may be mirror images of one another. Two 100Ω feed lines feed the two resonant slots 3904 in the upper half of the antenna 4000. The 100Ω feed lines are connected in parallel, such that the resulting resistance is 50Ω. This matches the resistance of the 50Ω main feed line 4004. When the lower half of the antenna 4000 is taken into account, the center of the antenna 4000 is at 25Ω, i.e., two 50Ω circuits in parallel. In some embodiments, the input impedance of the antenna 3900 may nonetheless be configured to be 50Ω by using an impedance matching pad of 35.35Ω.

Figure 41:
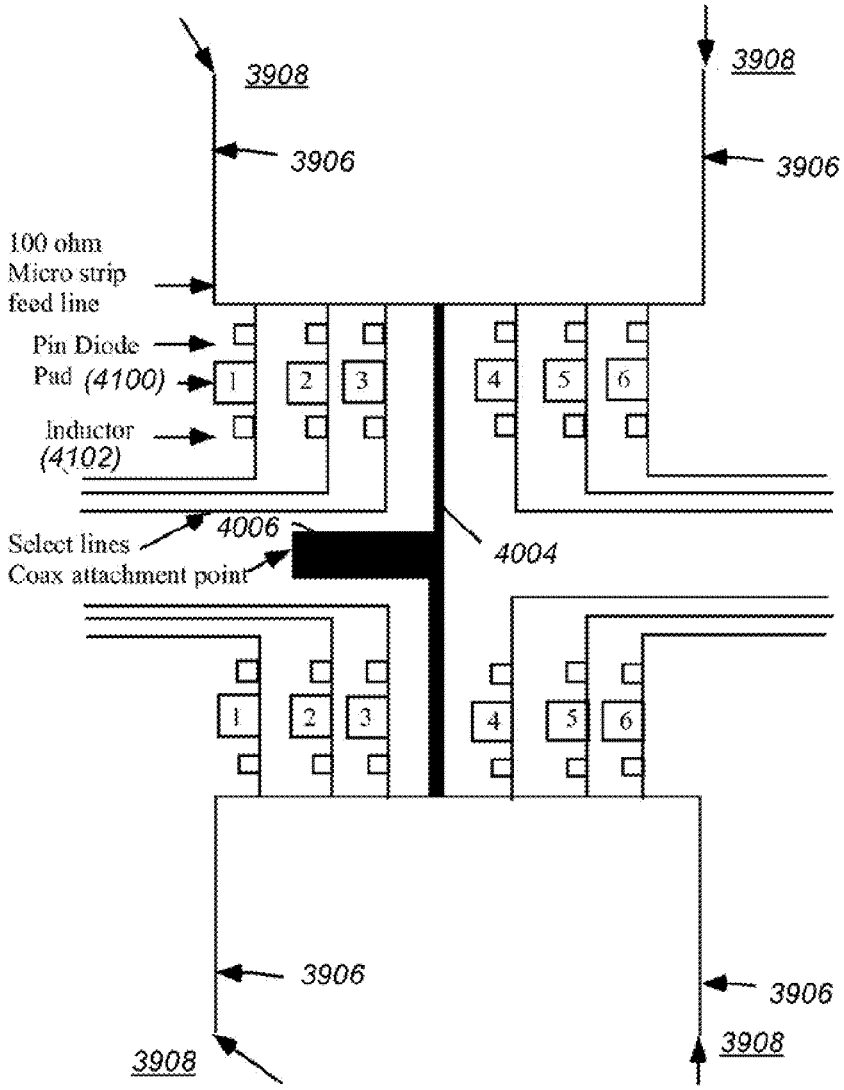
FIG. 41 illustrates exemplary delay electronics that are coupled with electrical microstrip feed lines for steering the phased array antenna shown in FIGS. 39 & 40.

FIG. 41 schematically illustrates an exemplary embodiment of the delay electronics 4002, coupled with the electrical microstrip feed lines 3906, for steering the phased array antenna 4000. Each of the microstrip feed lines 3906 is shown in FIG. 41 coupled with three groups of electronics, including a pin diode pad 4100 and an inductor 4102. The delay pads are enabled and disabled by a voltage of +5 Volts and −5 Volts respectively on select lines. By way of example, the antenna 4000 may be steered based on any or all of throughput, strength and signal-to-noise ratio.

Figure 42:
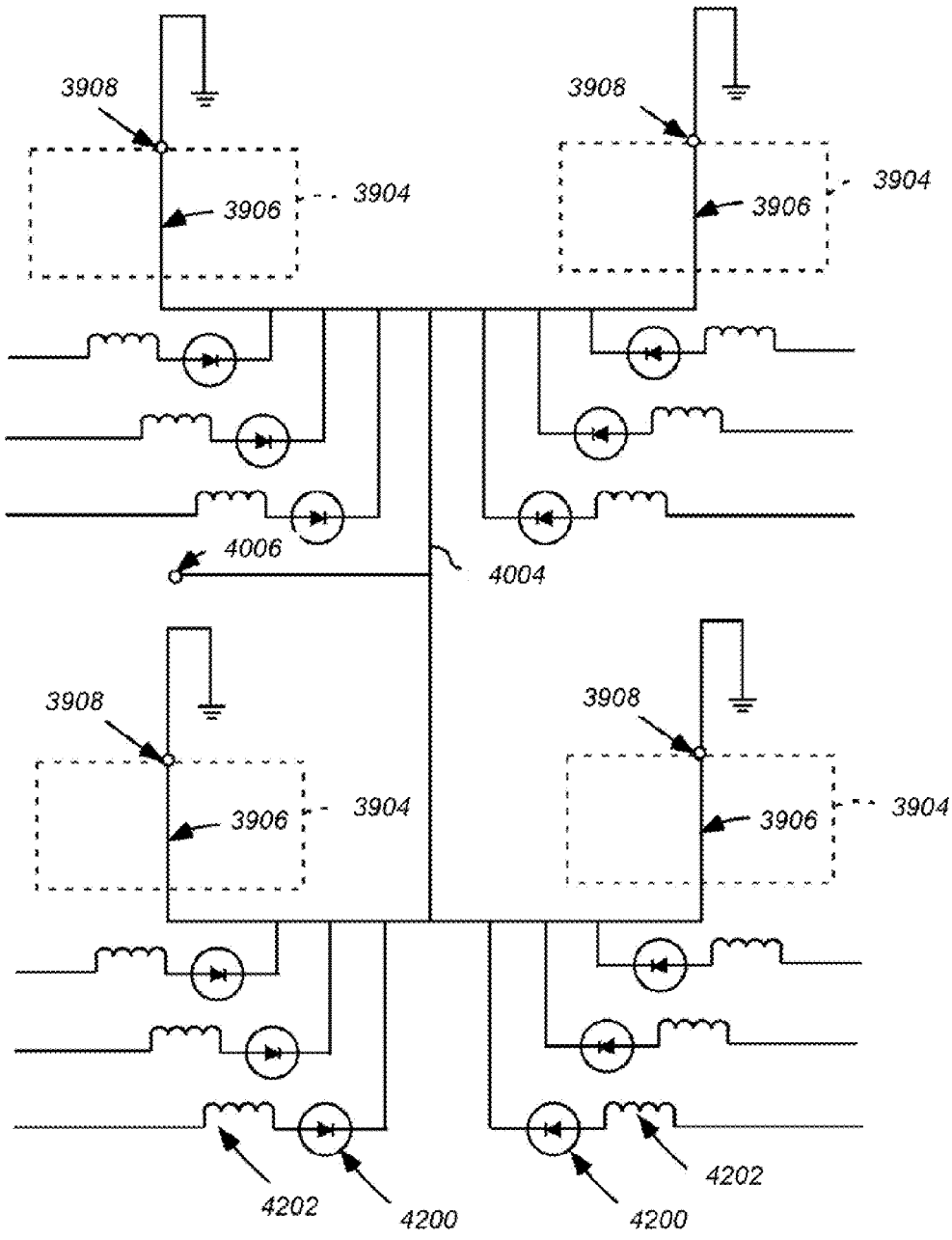
FIG. 42 illustrates an electronic component representation of elements of the phased array antenna shown in FIGS. 39 & 40.

FIG. 42 schematically illustrates an electronic component representation of the elements of the phased array antenna shown in FIGS. 39 & 40. The meander slots, electrical microstrip feed lines, main feed line, coax attachment point and feed line attachments points are shown. As also shown, the feed line attachment points are preferably grounded. The pin diode pads 4200 and inductors 4202 are illustrated with their common electrical representations.

Figure 43:
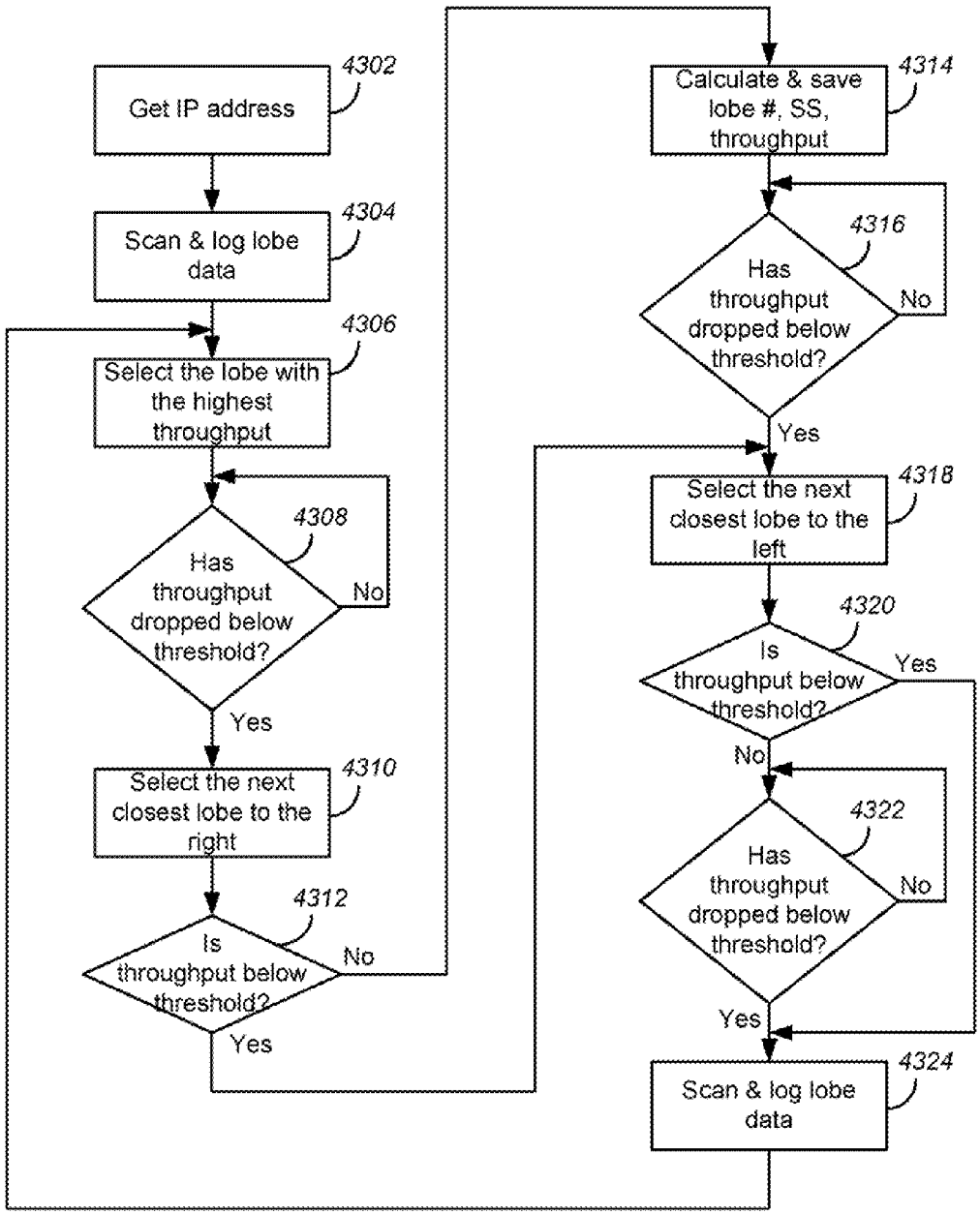
FIGS. 43 & 44 illustrate an exemplary flow of operations performed for selecting a signal distribution lobe of a phased array antenna.
Figure 44:
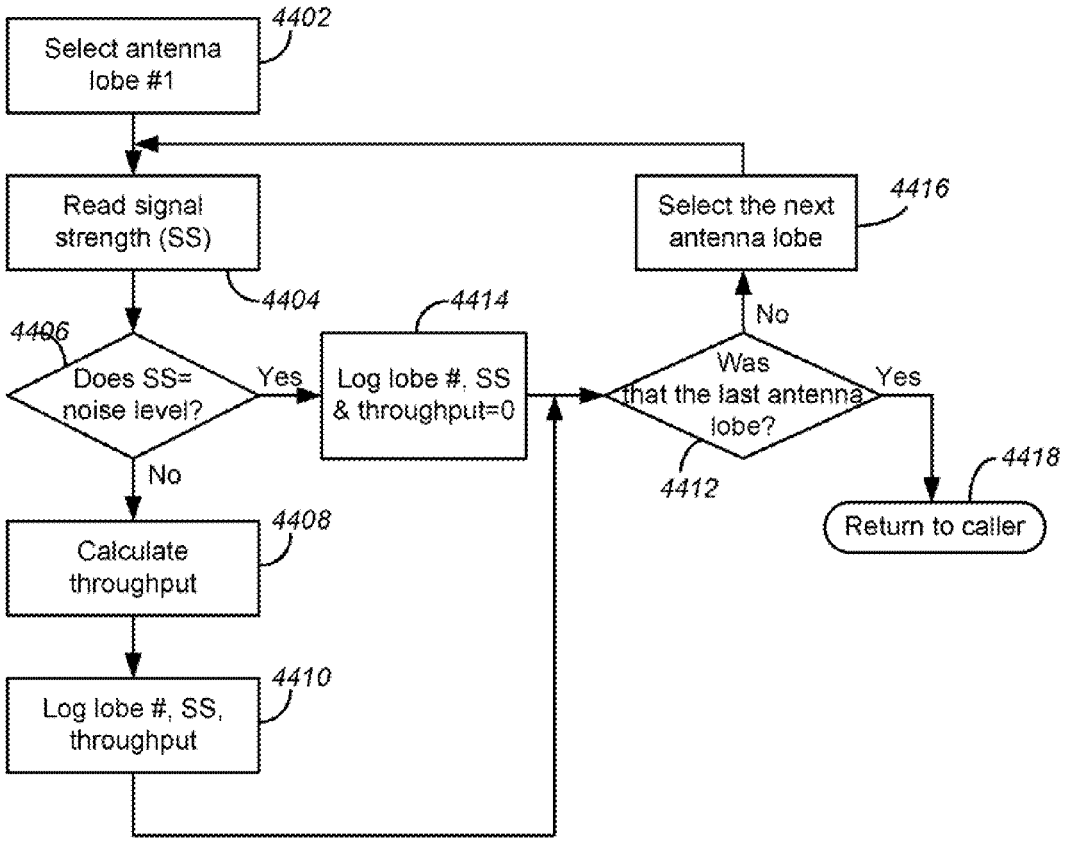

FIGS. 43 & 44 illustrate a flow of operations for selecting signal distribution lobes based on monitoring the throughput of lobes of a phased array antenna such as the one shown in FIGS. 39 & 40. Although two lobes or more than three lobes may be available, the example process of FIG. 43 assumes three lobes for purposes of illustration. At 4302, the IP address of a connected wireless device is obtained. At 4304, the lobe data is scanned and logged for this connection to the antenna. Of the lobes that may be selected, the lobe with the highest throughput is selected at 4306. Throughput is the speed at which a wireless network processes data end to end per unit time, typically measured in mega bits per second (Mbps). In this example, it will be assumed the middle of three lobes is selected.

This lobe is maintained as the selected lobe as long as the throughput remains above a threshold level. The threshold level may be a predetermined throughput level, or a predetermined throughput or percentage of throughput below a maximum, average or pre-set throughput level, or may be based on a comparison with other throughputs. At FIG. 44, which will be described in detail further below, if a signal strength falls to a noise level or within a certain amount of percentage of a noise level, then this fallen signal strength is used to determine when to select another lobe. The throughput is monitored according to the process of FIG. 43 continuously or periodically at 4308. The process remains at 4308, performing this monitoring unless it is determined that the throughput has dropped below the threshold level. Then, at 4310, another is lobe is selected such as the next closest lobe to the right. It is determined at 4312 whether the throughput with this lobe is above or below the threshold. If the throughput with this new lobe is above the threshold, then the process moves to 4314. At 4314, the lobe number and signal strength of the new lobe and/or other data are saved. Now, the monitoring at 4316 will go on with the new lobe as it did at 4308 with the initial lobe. That is, the process will periodically or continuously monitor the throughput of the connection with the new lobe. The process moves to 4318 only when the throughput with the new lobe is determined at 4316 to be below the threshold level. Referring back to 4312, if the throughput with the new lobe is determined there to be below the threshold, then the process moves directly to 4318. At 4318, yet another lobe, a third lobe, is selected such as the closest lobe to the left of the initial lobe. It is determined at 4320 whether the throughput is above or below the threshold. If it is above the threshold, then this lobe will remain the selected lobe unless and until the throughput falls below the threshold. If the throughput does drop below the threshold, then at 4324 lobe data is scanned and logged, and the process returns to 4306 to select the highest throughput lobe again.

The process at FIG. 44 illustrates monitoring of the signal strengths and other data of all of the lobes according to a further embodiment, e.g., to select the strongest lobe. Referring now to FIG. 44, lobe #1, e.g., is selected at 4402. The signal strength of the connection of a wireless device is read at 4404. If the signal strength is determined to be above a noise level, or alternatively if the signal strength is above some predetermined amount or percentage above the noise level, then the throughput is calculated at 4308. The lobe number, signal strength and throughput are logged at 4410 and the process moves to 4412. If, at 4406, the signal strength is determined to be at a noise level or at or below a predetermined amount or percentage above the noise level, then the lobe number, signal strength and throughput (equal to 0) are logged at 4414 and the process moves to 4414.

At 4412, it is determined whether the data regarding the last lobe has been processed. If it has not, then the process returns to 4404 to perform the monitoring for the next lobe. If the lobe data for all of the lobes has been monitored and determined, then the process returns to caller at 4418.

In each of the method flows shown in FIGS. 43 & 44, it is noted that only one exemplary flow of operations is shown. In other embodiments of these method flows, the operations forming a part thereof can be performed in other orders, and some operations may be performed in parallel. In some iterations, certain operations can be skipped or other operations can be performed in between those that are shown, as will be understood by one of ordinary skill in the art after reading this disclosure.

Figure 45:
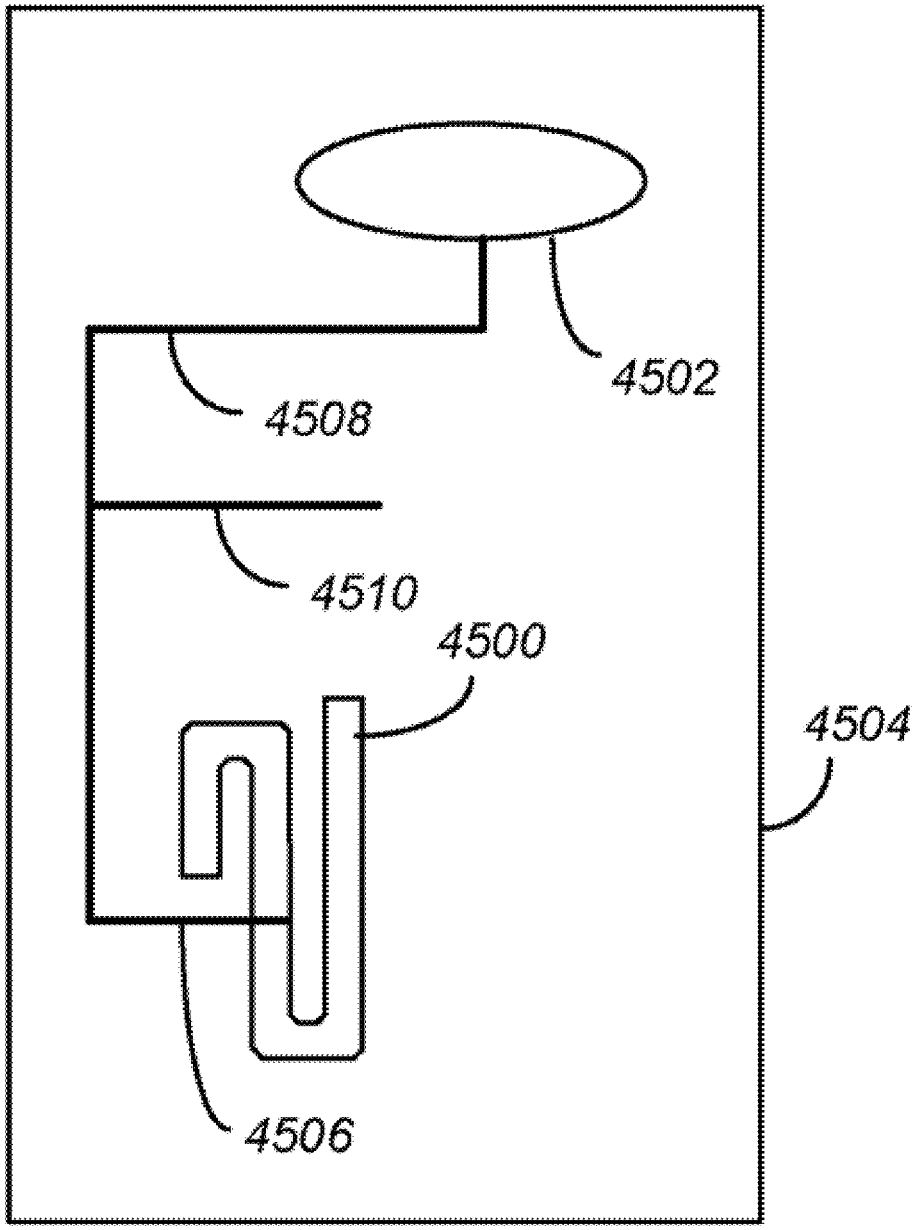
FIG. 45 illustrates an exemplary meander slot antenna coupled to an exemplary antenna not of the meander slot type.

In some antenna embodiments, a meander slot antenna may be coupled to one or more antennas that are not of the meander slot type; or, a meander slot antenna may be coupled to one or more other meander slot antennas, in addition to one or more antennas that are not of the meander slot type. One such embodiment is shown in FIG. 45, where both a meander slot antenna 4500 and an elliptical slot antenna 4502 are formed in a conducting sheet 4504. Each of these antennas 4500, 4502 is coupled to a respective electrical microstrip feed line 4506, 4508, which electrical microstrip feed lines 4506, 4508 are coupled to a common main feed line 4510. Of note, the particular elliptical slot antenna 4502 shown in FIG. 45 is not a resonant slot antenna, though it would certainly be possible to implement it as such. Alternately, the elliptical slot antenna 4502 could be replaced with a dipole antenna, a voltage fed slot antenna, or another type of antenna. In addition, one or more other antennas of the same or different type(s) could be coupled with the meander slot antenna 4500. Of note, the shape of the meander slot shown in FIG. 45 is exemplary only.

Figure 46:
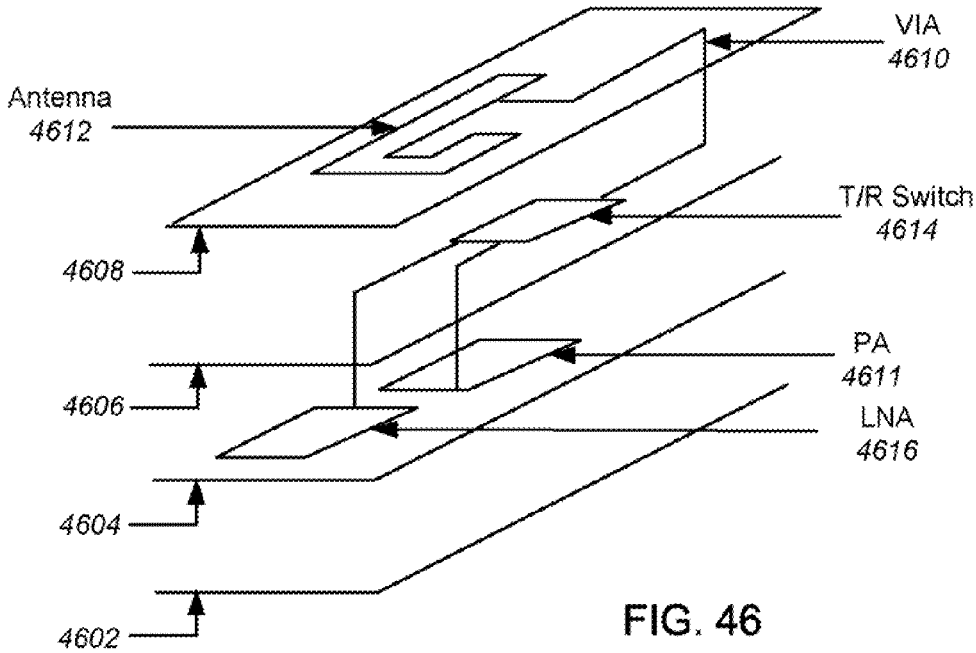
FIG. 46 illustrates an exemplary IC antenna.
Figure 47:
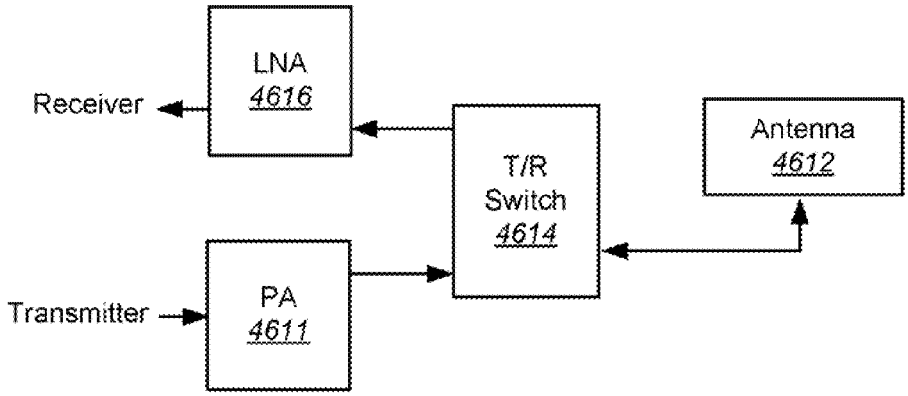
FIG. 47 illustrates components of the IC antenna shown in FIG. 46.

FIG. 46 shows an integrated circuit (IC) with a current drive slot in its top layer. The IC may be packaged as flip chips or using any other form of IC packaging. Four layers 4602, 4604, 4606 and 4608 are illustrated in FIG. 46. A via 4610 is provided in the top layer 4608 to a power amplifier 4611 in the third layer down 4604 that may be up to 20 dB. The antenna 4612 is also found at the top layer 4608. Capacitance is provided internally or externally. In this way, the frequency can be easily tuned. Batches of these may be provided in an IC, wherein a line-up configuration of ten of these slots 4612 may reduce powerline requirements by a factor of 10. Logical devices in each IC can be a Transmit/Receive Switch, or T/R Switch 4614, Low Noise Amplifier, or LNA 4616, and a Power Amplifier, or PA 4611. These components, i.e., antenna 4612, T/R switch 4614, power amplifier 4611, and low noise amplifier 4616 are also illustrated in block form in FIG. 46.

Figure 48:
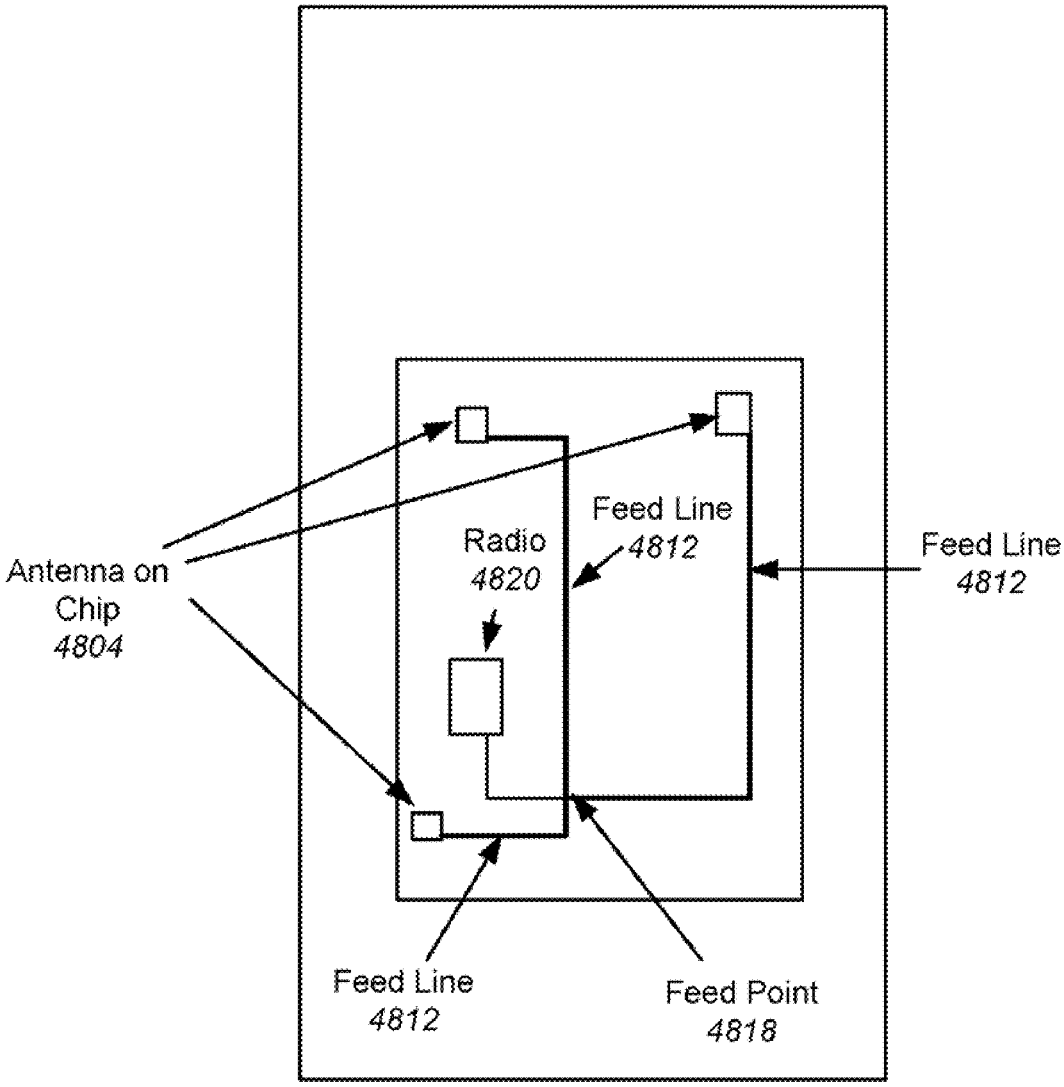
FIG. 48 illustrates an exemplary embodiment of an antenna that includes multiple slots and utilizes interferometry principles.

Interferometry principles may also be applied as illustrated at FIG. 48. That is, gains from slots having a same frequency and phase can be added. Two or more slots are used, with each slot working as a point source. Three slots 4804 are shown in FIG. 48, each having its own feed line 4812. The three feed lines connect at a common feed point 4818 and with the radio 4820 in the embodiment of FIG. 48. Each slot receives a different signal from a single source. The different signals are combined to show a three-dimensional picture of the single source.

Figure 49:
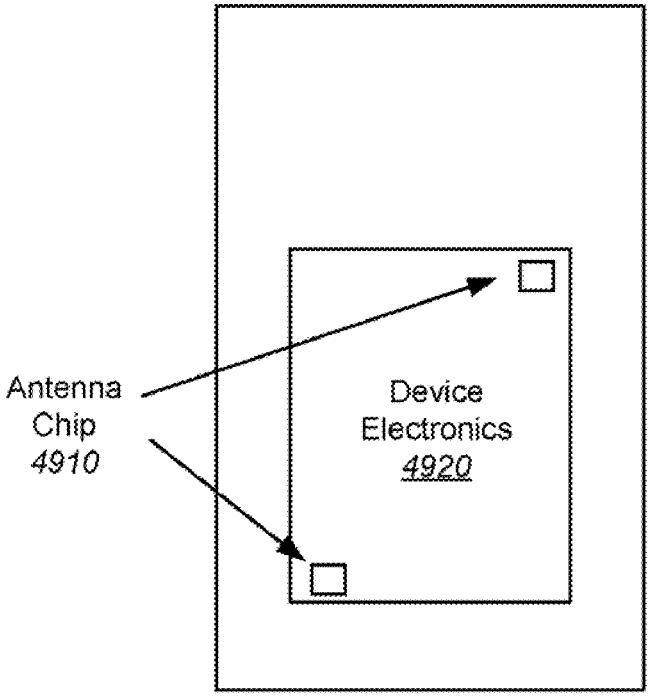
FIG. 49 illustrates an exemplary circuit board with two antenna chips.

A circuit board may be provided as illustrated at FIG. 49. Two chips 4910, i.e., ICs that are packaged as flip chips or otherwise, may be provided at corners of a circuit board that includes other device electronics 4920. The spacing of the two chips can be of any distance.

Figure 50:
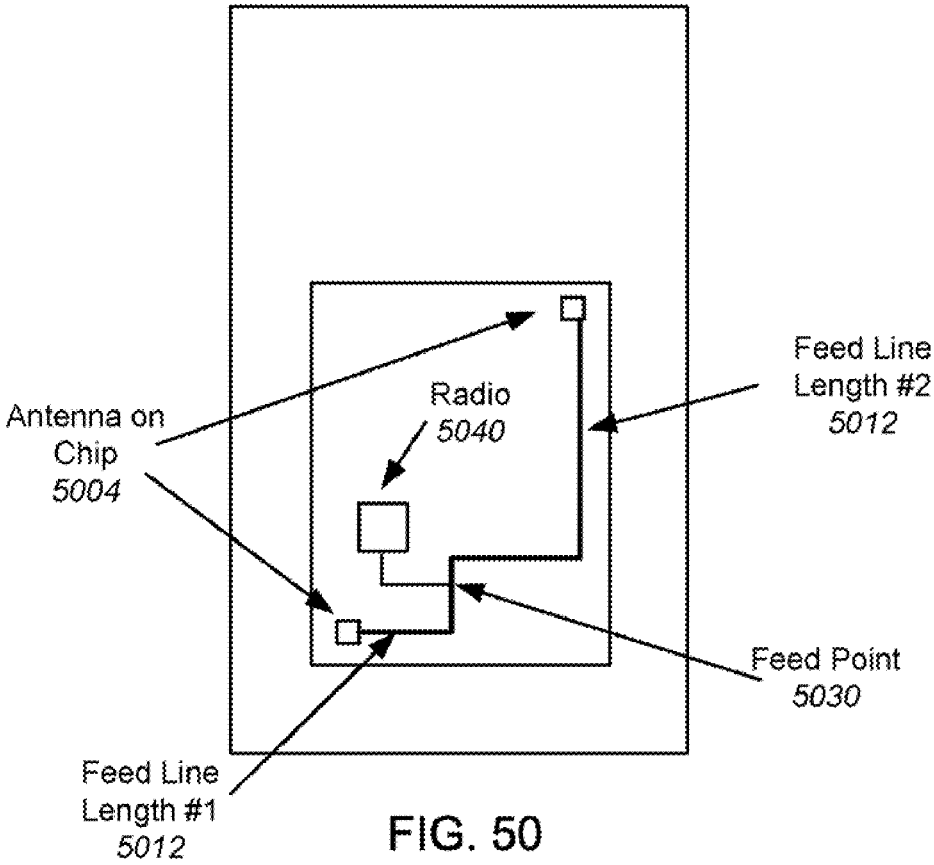
FIG. 50 illustrates an exemplary antenna having a synthetic aperture.

A synthetic aperture may also be provided as illustrated at FIG. 50, which shows radio 5040. Two or more slots 5004 having the same frequency are controlled by different length feed lines 5012 and 5022 emanating from a feed point 5030. The length of the feed lines corresponds to the spacing between the slots so that the slots intercept the signal at pre-defined points. This method may be used when the wavelength of the incoming signal is longer than the slot antenna. Two small slots are used to appear as one longer slot of larger aperture, forming a synthetic aperture.

Figure 51:
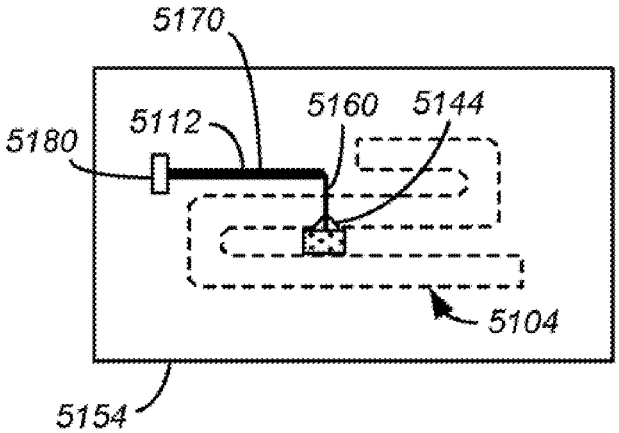
FIG. 51 illustrates an exemplary ultra wideband performance antenna having a meander slot.

Ultra wideband performance can be achieved, in some embodiments, as illustrated by the slot 5104 and feed line 5112 of FIG. 51. First, the Q is loaded by decreasing the amount of capacitance on the feed line 5112 at the slot 5104. This is achieved by decreasing the size of the triangle projection 5144 on the back side of the printed circuit board (PCB) 5154. Second, the impedance of the feed line segment 5160 that crosses the slot is less than 100Ω. Then, the feed line 5112 transitions to a wider segment 5170 that has an impedance of 50Ω to the source 5180.

Figure 52:
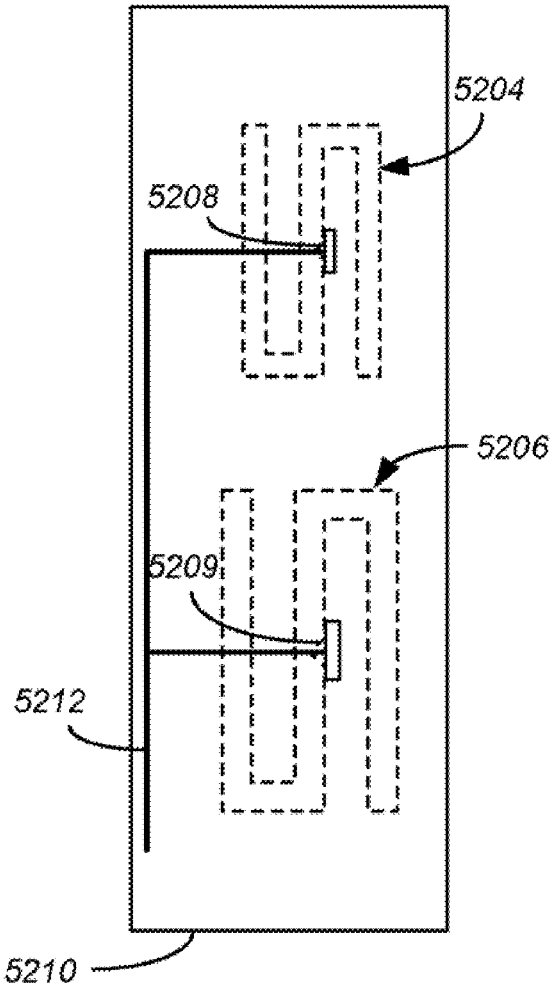
FIG. 52 illustrates an exemplary antenna with enhanced ultra wideband and dual band performance.

Enhanced ultra wideband and dual band performance can be achieved, in some embodiments, as illustrated in FIG. 52. For example, two ultra wideband meander slot antennas 5204 and 5206, or one standard meander slot antenna and one wideband antenna, can be placed on a common substrate 5210 and fed by a common feed line 5212. The slots 5204 and 5206 can be configured to resonate at different frequencies. The bandwidth and center frequency of each meander slot antenna can be adjusted so that the frequency spectrum of the two meander slot antennas overlaps. The bandwidth and center frequency of each meander slot antenna can also be adjusted for different frequency bands, where the frequency spectrums of the bands do not overlap.

What is claimed is:

1. A meander slot antenna, comprising:

a conducting sheet having a meander slot defined therein, the meander slot having a closed area defined by the conducting sheet;

an electrical microstrip feed line crossing the meander slot, the electrical microstrip feed line and meander slot providing a magnetically coupled LC resonance element; and a dielectric material having a plurality of conductive vias therein, the plurality of conductive vias electrically connecting the electrical microstrip feed line and the conducting sheet at a side of the meander slot, the dielectric material otherwise separating the conducting sheet from the electrical microstrip feed line.

2. The meander slot antenna of claim 1, wherein the dielectric material comprises FR4.

3. The meander slot antenna of claim 1, wherein the electrical microstrip feed line crosses the meander slot at a midpoint of the meander slot.

4. The meander slot antenna of claim 1, wherein the electrical microstrip feed line crosses only one of a plurality of slot segments of the meander slot.

5. The meander slot antenna of claim 1, wherein the electrical microstrip feed line crosses the meander slot only once and has i) a first section that crosses one of a plurality of slot segments of the meander slot, and ii) a second section routed between adjacent ones of the plurality of slot segments, the second section having a different orientation than the first section.

6. The meander slot antenna of claim 5, further comprising a coax cable connected to the electrical microstrip feed line, the coax cable having a route that does not cross the meander slot.

7. The meander slot antenna of claim 1, wherein all of a plurality of slot segments of the meander slot have a uniform width.

8. The meander slot antenna of claim 1, wherein the plurality of conductive vias coupling the electrical microstrip feed line to the conductive sheet is positioned between adjacent ones of a plurality of connected slot segments of the meander slot.

9. The meander slot antenna of claim 1, wherein the conducting sheet further has a protrusion into the meander slot defined therein, and wherein the electrical microstrip feed line crosses the protrusion.

10. The meander slot antenna of claim 9, wherein the protrusion is triangular.

11. The meander slot antenna of claim 9, wherein the protrusion is rectangular.

12. The meander slot antenna of claim 9, wherein the protrusion s elliptical.

13. The meander slot antenna of claim 1, wherein the electrical microstrip feed line crosses a side of the meander slot at other than a 90 degree angle.

14. The meander slot antenna of claim 1, wherein the electrical microstrip feed line crosses a side of the meander slot at a 45 degree angle.

15. The meander slot antenna of claim 1, wherein the electrical microstrip feed line crosses the meander slot at a corner of the meander slot.

16. The meander slot antenna of claim 1, wherein the meander slot comprises a plurality of slot segments, each of the slot segments connected to at east one other of the slot segments at a 90 degree angle.

17. The meander slot antenna of claim 1, wherein the meander slot comprises a plurality of slot segments, at least one of the slot segments having i) a length, and ii) differing widths at two or more points along the length.

18. The meander slot antenna of claim 1, wherein the meander slot comprises a plurality of slot segments, at least one of the slot segments having a length and a width, the width flaring out over at least a portion of the length.

19. The meander slot antenna of claim 1, further comprising a capacitor, the capacitor having i) first and second terminals coupled to the conductive sheet, and ii) first and second spaced plates, each of the first and second spaced plates projecting across the meander slot, and the dielectric material separating the conducting sheet from the first and second spaced plates.

20. The meander slot, antenna of claim 1, wherein the conducting sheet further has a capacitor defined therein, the capacitor formed across the meander slot, and the capacitor having first and second plates that are respectively coupled to first and second sides of the meander slot.

21. A mobile phone device including the meander slot antenna of claim 1.

22. An integrated circuit including the meander slot antenna of claim 1.

23. The meander slot antenna of claim 1, wherein the electrical microstrip feed line includes at least one segment of greater width than other segments of the microstrip feed line, the at least one segment of greater width reducing electrical resistance and produce an enhanced q-factor to provide a broader bandwidth for the meander slot antenna.

24. The meander slot antenna of claim 1, wherein the electrical microstrip feed line crosses the meander slot closer to one end of the meander slot.

25. The meander slot antenna of claim 1, further comprising a coax cable connected to the electrical microstrip feed line.

26. The meander slot antenna of claim 1, wherein:

the conducting sheet has at least one additional meander slot defined therein;

the meander slot antenna further comprises at least one additional electrical microstrip feed line, each of the at least one additional electrical microstrip feed line crossing a respective one of the at least one additional meander slot to provide at least one additional magnetically coupled LC resonance element; and the meander slot and the at least one additional meander slot complement each other in a phased array pattern.

27. The meander slot antenna of claim 1, wherein:

the conducting sheet has at least one additional slot defined therein; and the antenna further comprises at least one additional electrical microstrip feed line, each of the at least one additional electrical microstrip feed line coupled with a respective one of the at least one additional slot.

28. The meander slot antenna of claim 27, wherein the meander slot and at least one of the additional slot have different configurations and are of different resonant frequencies.

29. The meander slot antenna of claim 27, further comprising;

delay circuitry for electronically steering the meander slot antenna by selectively changing signal phases on at least one of the electrical microstrip feed lines; and one or more processors operating based on program code that continuously or periodically determine a preferred signal direction and control the delay circuitry to steer the antenna in the preferred direction.

30. A meander slot antenna, comprising:

a conducting sheet having a meander slot defined therein, the meander slot having a closed area defined by the conducting sheet;

an electrical microstrip feed line crossing only one of a plurality of slot segments of the meander slot, wherein i) the electrical microstrip feed line is connected to the conducting sheet at a side of the meander slot, between adjacent ones of the slot segments of the meander slot, and ii) the electrical microstrip feed line and meander slot provide a magnetically coupled LC resonance element, and a dielectric material separating the conducting sheet from the electrical microstrip feed line, but for where the electrical microstrip feed line is connected to the conducting sheet.

31. The meander slot antenna of claim 30, wherein the electrical microstrip feed line has i) a first section that crosses only one of the plurality of slot segments of the meander slot, and ii) a second section that follows a path between adjacent ones of the plurality of slot segments.

32. The meander slot antenna of claim 31, further comprising a coax cable connected to the electrical microstrip feed line, the coax cable having a route that does not cross the meander slot.

33. The meander slot antenna of claim 30, further comprising a coax cable connected to the electrical microstrip feed line, the coax cable having a route that does not cross the meander slot.

34. A slot antenna, comprising:

a conducting sheet having i) a slot defined therein, the slot having a closed area defined by the conducting sheet, and ii) a capacitor defined therein, the capacitor formed across the slot, and the capacitor having first and second plates that are respectively coupled to first and second sides of the slot;

an electrical microstrip feed line crossing the slot, wherein i) the electrical microstrip feed line connected to the conducting sheet at a side of the slot, and ii) the electrical microstrip feed line and slot provide a magnetically coupled LC resonance element; and a dielectric material separating the conducting sheet from the electrical microstrip feed line, but for where the electrical microstrip feed line is connected to the conducting sheet.

35. The slot antenna of claim 34, wherein the slot is a meander slot.

36. The slot antenna of claim 34, wherein the slot is a rectangular slot.

37. A slot antenna, comprising:

a conducting sheet having a slot defined therein, the slot having a closed area defined by the conducting sheet;

an electrical microstrip feed line crossing the slot, wherein i) the electrical microstrip feed line connected to the conducting sheet at a side of the slot, and ii) the electrical microstrip feed line and slot provide a magnetically coupled LC resonance element;

a dielectric material separating the conducting sheet from the electrical microstrip feed line, but for where the electrical microstrip feed line is connected to the conducting sheet; and a capacitor having i) first and second terminals coupled to the conductive sheet, and ii) first and second spaced plates, each of the first and second spaced plates projecting across the meander slot, wherein the dielectric material separates the conducting sheet from the first and second spaced plates.

38. The slot antenna of claim 37, wherein the slot is a meander slot.

39. The slot antenna of claim 37, wherein the slot is a rectangular slot.

40. A method, comprising:

providing a meander slot in a conducting sheet on a first side of a dielectric material, the meander slot having a plurality of slot segments;

on a second side of the dielectric material, opposite the first side of the dielectric material, providing an electrical microstrip feed line, the electrical microstrip feedline j routed to cross the meander slot only once, and ii)

together with the meander slot provide a magnetically coupled LC resonance element; and electrically connecting the electrical microstrip feed line to the meander slot using a plurality of conductive vias formed in the dielectric material, at a position between adjacent ones of the plurality of slot segments.

41. The method of claim 40, further comprising:

connecting a coax cable to the electrical microstrip feed line, the coax cable routed to cross the meander slot only once.

* * * * *